US011202480B2

(12) United States Patent
Brown

(10) Patent No.: US 11,202,480 B2
(45) Date of Patent: Dec. 21, 2021

(54) SECURE HAIR WRAP

(71) Applicant: Ashley Brown, Wayne, PA (US)

(72) Inventor: Ashley Brown, Wayne, PA (US)

( * ) Notice: Subject to any disclaimer, the term of this patent is extended or adjusted under 35 U.S.C. 154(b) by 0 days.

(21) Appl. No.: 16/704,414

(22) Filed: Dec. 5, 2019

(65) Prior Publication Data

US 2020/0178634 A1 Jun. 11, 2020

Related U.S. Application Data

(60) Provisional application No. 62/775,457, filed on Dec. 5, 2018.

(51) Int. Cl.
*A42B 1/041* (2021.01)

(52) U.S. Cl.
CPC ..... *A42B 1/041* (2013.01)

(58) Field of Classification Search
CPC ..... A42B 1/0414; A42B 1/049; A42B 1/06; A42B 1/208; A42B 1/22; A42B 1/04; A42B 1/206; A42B 1/006; A42B 1/012; A42B 1/018; A42B 1/0186; A42B 1/0187; A42B 1/201; A45D 8/40
USPC ..... 2/DIG. 11, 174, 181, 181.2
See application file for complete search history.

(56) References Cited

U.S. PATENT DOCUMENTS 1,948,556 A * 2/1934 Armsby ..... A45D 8/40 2/174
2,560,267 A * 7/1951 Baker ..... A45D 8/36 132/273
3,587,114 A * 6/1971 McCourtie ..... A42B 1/041 2/67
4,031,567 A * 6/1977 Planck ..... A42B 1/041 2/204
5,490,528 A * 2/1996 Day ..... A42B 1/04 132/200
5,598,585 A * 2/1997 Stroup ..... A41D 20/00 2/171
5,685,016 A * 11/1997 Douglas ..... A41D 23/00 2/171
6,247,181 B1 * 6/2001 Hirsch ..... A42B 1/041 2/171
6,427,251 B1 * 8/2002 Leach ..... A42B 1/041 2/174
7,350,241 B2 * 4/2008 Gendall ..... A41D 23/00 2/173
2002/0104150 A1 * 8/2002 Hill ..... A42B 1/041 2/174
2007/0118971 A1 * 5/2007 Blecha ..... A42C 5/00 2/207
2008/0022438 A1 * 1/2008 Schweers ..... A42B 1/0189 2/181
2012/0216334 A1 * 8/2012 Brown ..... A42B 1/041 2/209.13

(Continued)

*Primary Examiner* — Amy Vanatta
(74) *Attorney, Agent, or Firm* — Caesar Rivise, PC

(57) ABSTRACT

The disclosure relates to a hair wrap for securing cranial hair of a human during sleep, exertion, or exposure to the elements, for example. The wrap includes a slip-resistant material positioned at or near an inferior edge that extends about the hairline of the wearer. One or more fastener pairs have halves positioned at lateral ends of the wrap and are used to secure the wrap to the head. An extension of the wrap can enclose or envelop the hair, preventing disruption of hairstyles or undesired contact of the hair with external substances.

20 Claims, 12 Drawing Sheets

(56) References Cited

U.S. PATENT DOCUMENTS

| | | | | |
|---|---|---|---|---|
| 2017/0020221 | A1* | 1/2017 | Harsh | A42B 7/00 |
| 2021/0068482 | A1* | 3/2021 | Brown | A42B 1/041 |

* cited by examiner

SECURE HAIR WRAP

CROSS-REFERENCES TO RELATED APPLICATIONS

This application is entitled to priority to U.S. provisional patent application No. 62/775,457 filed 5 Dec. 2018.

BACKGROUND OF THE DISCLOSURE

The invention relates generally to the field of human head coverings, more specifically to easily applied and removed head coverings for inhibit tousling of hairstyles, such as during sleep, exercise, or exposure to wind and weather.

Cranial hair is a characteristic shared by virtually all humans, at least in early stages of human life. Hair grows in the form of fibrous shafts which extend outwardly from specialized skin structures known as follicles. Hair growth occurs cyclically, with active growth occurring within the follicle, causing a hair shaft to extend distally outward through a cylindrical opening in the skin surface and grow progressively longer before growth halts. After a period of time, growth of a new hair from the same follicle may commence, at which time any previously-grown hair remaining within the follicular opening can be released or forced out by the new growing hair. Because the duration of the cycle of hair growth varies among individuals, some individuals' hair (i.e., the hair of they with longer hair growth cycles) will normally grow longer than the hair of other individuals (i.e., they having shorter hair growth cycles).

Differences in hair structure among various individuals result in some individuals' hair growing outwardly in substantially straight shafts, while other individuals' hair will exhibit curls having a relatively large radius of curvature (i.e., "wavy" hair), tighter curls having a relatively smaller radius of curvature (i.e., "curly" hair), or still-more-tightly curled hair having a spring-like or zig-zag-like conformation. The color and thickness of cranial hair also vary among individuals, and all of these variations sometimes differ at different periods of the life of an individual human. Thus, even without intentional manipulation of hair, a variety of hair lengths, colors, orientations, types, and styles would result from the natural operation of hair growth among individual humans.

Throughout recorded history, humans have sought to arrange their cranial hair into distinctive hairstyles. Although some hairstyles encompass free repositioning of hairs, many hairstyles require that many or most hairs be maintained in approximately fixed positions and with approximately fixed orientations. Hairstyles are imposed upon hairs by cutting, combing, brushing, pulling, braiding, weaving, heating, curling or otherwise positioning individual hairs or groups of hairs, and waxes, pastes, pomades, hairsprays, gels, cremes, and other products are sometimes used to fix or hold hairs in position.

Human hairstyles can have both aesthetic and functional purposes. For aesthetic reasons, humans often arrange their own hair, or the hair of others, into hairstyles which are considered to be visually pleasing when a person is viewed by others and/or comfortable to the person whose hair is arranged. For functional reasons, human hair is sometimes arranged into hairstyles which reduce the likelihood of hair being caught in nearby machinery, which serve as distinguishing characteristics for individuals, or which position hair appropriately for application of chemicals (e.g., dyes or bleaches) thereto. In each of these situations (and others), maintenance of hair in a selected hairstyle is considered desirable.

Apart from intentional disposition of hair into hairstyles, hair position and orientation are often affected by unintentional influences, such as the effects upon hair of gravity, wind, humidity, rain, heat, bathing, and impingement of objects upon the head. Non-desired repositioning of hair can disrupt hairstyles, requiring repair or reformation of the hairstyle. Furthermore, prolonged heating or pressure upon hair (e.g., sleeping upon hair or wearing a hat), can cause non-desired disruption of hairstyle.

A wide variety of devices and compositions exist for preserving human hairstyles during a variety of operations. For example, "shower caps" are well known devices for preserving hairstyles while bathing; see, e.g., U.S. Pat. No. 6,820,283 to Graneto and U.S. Patent Publication No. 2016/0100648 to DeJesu. Many shower caps consist of a band of material, generally sewn or closable into a circular conformation, that can be extended snugly around the head while bathing (e.g., by making the band from an elastic material or including an elastic material as a part of the band). Attached to the elastic band is a "bag" or hemisphere of water-proof or water-resistant material. Shower caps are used by inserting the hair-bearing surfaces of one's head within the "bag" and thereafter sealing the opening of the "bag" snugly against the outer surface of one's head (preferably below the hairline), so that water that is incident upon the head while bathing will be prevented, by the shower cap, from contacting the cranial hair. Also well-known are wraps and hoods for enclosing hair, such as before or after bathing; see, e.g., U.S. Pat. No. 6,560,784 to Hill and U.S. Pat. No. 8,316,466 to Saito. A significant drawback of wraps, hoods, and shower caps is that they enclose the superior surface (i.e., the "top") of the head, meaning that an appropriate size must be selected to accommodate a person's hairstyle—particularly when the hairstyle includes significant vertically-oriented elements. Furthermore, wraps, hoods, and caps which enclose the top of the head tend to require significant movement of the device in a superior-to-inferior anatomical direction, increasing the likelihood that hairstyle elements will be displaced as the device is installed upon the head. Yet another drawback is that—however beneficial a closed "top" of such devices might be for preventing infiltration of water during bathing—closed-top devices can be uncomfortable to wear, especially for prolonged periods, and more especially during hot or humid conditions.

A significant need exists for a device that permits humans to protect hairstyles from displacement that is efficacious for preventing non-desired displacement of hair, simple to apply and remove, and sufficiently comfortable to wear for extended periods. The subject matter described herein satisfies these needs.

BRIEF SUMMARY OF THE DISCLOSURE

The disclosure relates to a wrap for securing hair on the head of a person. The wrap includes a sheet that extends in orthogonal lateral and longitudinal directions. The sheet has an inferior edge and a superior edge at opposite longitudinal ends thereof, first and second lateral ends, a proximal face, and a distal face. The inferior edge extends in the lateral direction between the first and second lateral ends. The proximal face bears, closely adjacent the inferior edge, both a slip-resistant material and one half of a primary fastener pair. The distal face bears the other half of the primary fastener pair closely adjacent the inferior edge. The lateral distance between the two halves of the primary fastener pair is equal to the approximate hairline circumference of the person (e.g., about 18-28 inches, perhaps as small as 12 inches for child versions). The superior edge is positioned sufficiently longitudinally distant from the inferior edge that the hair of the person is substantially contained within the sheet when the inferior edge of the sheet is extended about the hairline of the person and the two halves of the primary fastener pair are fastened to one another.

Numerous variations of the wrap are described herein. For example, the wrap can also include a secondary fastener pair, one half of the secondary fastener pair borne by the proximal face of the sheet, not adjacent the inferior edge; and the other half of the secondary fastener pair borne by the distal face of the sheet, not adjacent the inferior edge. When present, the lateral distance between the two halves of the secondary fastener pair can be from 75% to 125% the lateral distance between the two halves of the primary fastener pair, for example. The wrap can include multiple secondary fastener pairs.

In another embodiment, the sheet from which the wrap is constructed has a band-shaped portion and includes an extension extending longitudinally between the band-shaped portion and the superior edge. For example, the longitudinal dimensions of the extension can be sufficient to enclose straight cranial hair having a length of at least 12 (or at least 24) inches when the wrap is worn about the head of a person.

The sheet from which the wrap is constructed can be a unitary piece of fabric. It can also be a laminated plurality of fabric pieces.

The slip-resistant material can be a rubberized finish applied to the sheet or a discrete material attached to the sheet adjacent the inferior edge. Examples of suitable materials include natural rubbers, silicone rubbers, and polyethylene-vinyl acetates. The slip-resistant material is preferably positioned adjacent the entire inferior edge at least along two (preferably at least four) inches of its length. More preferably, the slip-resistant material is positioned adjacent substantially the entire inferior edge.

The wrap can include a tail for facilitating knotting of the wrap about hair contained therein.

The wrap can be used by a person to reduce disruption of a cranial hairstyle during sleep.

BRIEF SUMMARY OF THE SEVERAL VIEWS OF THE DRAWINGS

FIG. 11 consists of FIGS. 11A-11F.

DETAILED DESCRIPTION

Figure 1A:
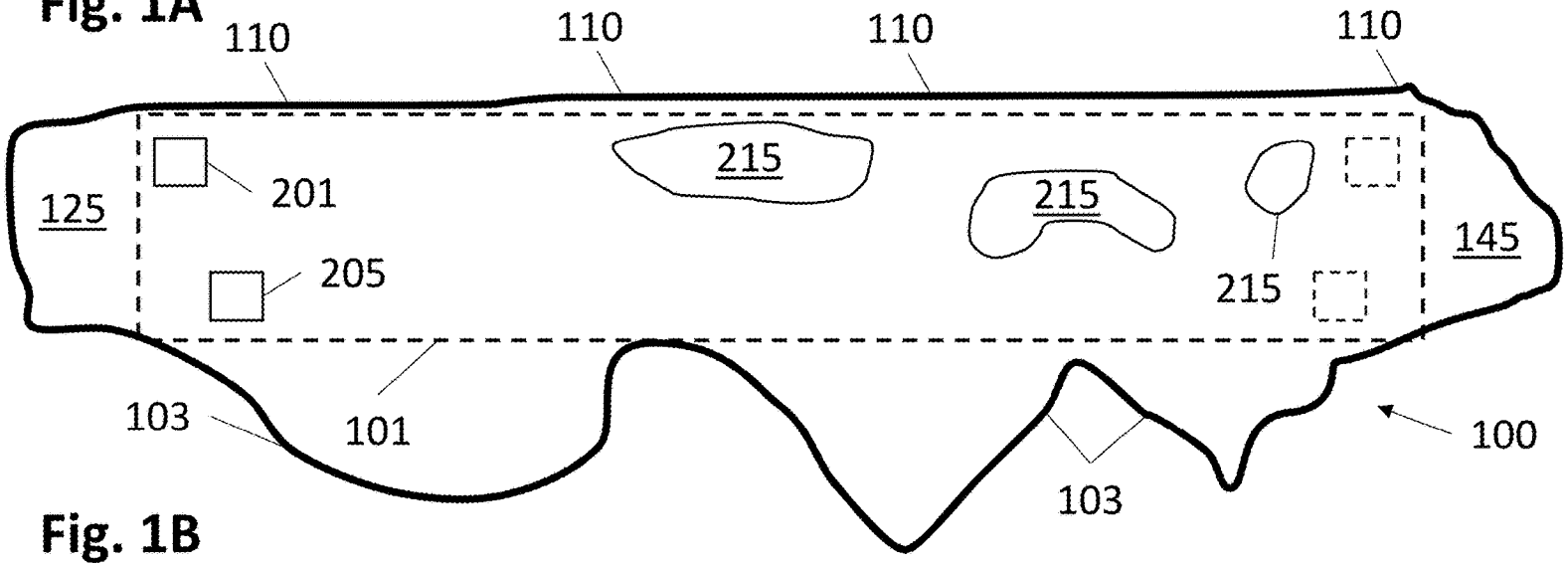
FIG. 1 consists of FIGS. 1A and 1B and is a pair of diagrams depicting the proximal (FIG. 1A) and distal (FIG. 1B) aspects of the wrap 100 described herein.

The disclosure relates to devices for securing cranial hair of a person, so as to prevent tousling and disruption of hairstyles.

The device disclosed herein takes the form of a wrap 100 that includes a sheet 400 that can wrapped around the head at approximately the hairline, to contain some or all cranial hair of the wearer within it. The wrap is described herein as extending in orthogonal lateral (side-to-side or around-the head) and longitudinal (hairline to hair-tips) directions to facilitate its description. The wrap 100 has an inferior edge 110 that extends in the lateral direction, the inferior edge being intended to be positioned at or near the hairline of the individual wearing the wrap. The wrap also has a first lateral end 120 and a second lateral end 140 positioned at opposite sides; these ends are wrapped about the head (often with one end held in place while the other is wrapped). The wrap also has a superior edge 130 opposite the inferior edge.

Being made from one or more sheets of material, the wrap has two faces or "sides." When the wrap is worn, one face generally is opposed against the hair and skin; this face of the wrap is herein designated the proximal face 200. The proximal face will usually be hidden from view during use, so its visual appearance is not critical. The proximal face should generally be free of surface features (e.g., rhinestones, studs, sticky portions) that have a tendency to snag hair, with the possible exception of fastener halves described herein. The opposite face of the wrap is termed the distal face 300, and generally faces away from the hair and skin. It is the distal face of the wrap that is generally visible to others while the wrap is being worn, and so the visual appearance of the distal face may include designs, patterns, logos, trademarks, appliques, or other surface treatments.

An important feature of the hair wrap is that the wrap 100 bears, closely adjacent the inferior edge 110 both a slip-resistant material 215 on its proximal face 200 and one half of a fastener pair (herein designated the primary fastener pair) on its distal face 300. One half of the primary fastener pair 301 borne by the distal face should be at or near one lateral end of the wrap. The second half of the primary fastener pair 201 should be born on the proximal face of the wrap, at or near the other lateral end, and generally about as close to the inferior edge as the first half. An important purpose of the slip-resistant material is to prevent the wrap from significantly shifting its position, in the longitudinal direction, while the wrap is worn. The two halves of the primary fastener pair 201 and 301 serve to hold the wrap in a generally annular shape about the head (i.e., to prevent the ends from separating and the wrap from un-wrapping) and to draw the slip-resistant material into the conformation of a comfortably-tensioned band about the head (i.e., tension sufficient to urge the slip-resistant material against the head, but not so high as to cause discomfort to the wearer). When the halves of the primary fastener pair are fastened to one another, the wrap encircles the head, and the slip-resistant material is positioned at or near the hairline and prevents slippage of the wrap. Thus, the wrap contains some or all of the wearer's cranial hair and neither falls off nor slips down over the wearer's face when in normal use.

To don the wrap, the proximal face 200 of the wrap 100 is applied to the head of the wearer, with the slip-resistant material 215 positioned at or near the hairline and the first half of the primary fastener pair 301 (on the distal face 300) facing outwardly from the head. The inferior edge 110 of the wrap is positioned toward the face or directed downwardly (i.e., in the inferior direction). The wrap is then wrapped around the head, with any additional slip-resistant material preferably being positioned at or near the corresponding portion of the wearer's hairline, and the second half of the primary fastener pair 201 (on the proximal face) is aligned with and fastened to the first half, thereby securing the wrap.

When the hairline circumference of the wearer is known during manufacture of the wrap, the two halves of the primary fastener pair 201 and 301 can be positioned on opposite faces of the wrap, with the lateral distance between them being equal to the wearer's hairline circumference. In the more common situation in which the hairline circumference of a future wearer is unknown (or the wrap is made to fit wearers having a variety of head sizes), a plurality of one or both halves of the primary fastener pair can be attached to the respective face of the wrap. For example, if the primary fastener pair is a hook-and-eye type fastener, a single hook 201 may be attached on the proximal face 200 of the wrap, at or near the first lateral end 120 and closely adjacent the inferior edge 110. If the hairline circumference of the wearer is known, a single eye 301 can be attached to the distal face of the wrap, nearer the second lateral end 140 and equally closely adjacent the inferior edge, with the lateral distance between the hook and the eye being equal to the wearer's hairline circumference. If the hairline circumference of the wearer is not known, multiple eyes 301 can be attached to the distal face of the wrap toward the second lateral end, each equally closely adjacent the inferior edge and with the lateral distance between the hook and the various eyes being different for the various eyes. In this way, the wrap can be used by individuals having unknown head sizes, so long as each individual's hairline circumference is within the range of lateral distances embodied in the wrap. Multiple halves of the fastener pairs also permit wearers to adjust the tightness of the wrap for comfort, for varying hairstyles, and for different intensities of expected activity (e.g., more tightly for dancing than for sleeping or more tightly for sleeping than for watching television).

The position of the superior edge 130 of the wrap 100 is not critical. The superior edge is preferably positioned sufficiently longitudinally distant from the inferior edge 110 that the hair of the person is substantially contained within the sheet 400 when the inferior edge of the sheet is extended about the hairline of the person and the two halves of the primary fastener pair 201 and 301 are fastened to one another. This will contain at least the hair near the hairline. The greater the distance the superior edge extends from the inferior edge, the more of the sheet will be available to cover, shield, or wrap the hair. To provide protection for relatively short hair, the distance between the superior edge and the inferior edge should be at least a few inches (e.g., about five to six inches, and preferably at least about ten to twelve inches). There is no effective upper limit on the distance between the superior and inferior edges, and individuals having longer (or taller) cranial hair will require greater distances than shorter-haired individuals if the hair is to be wrapped.

The wrap 100 will generally include a band-shaped region having a lateral width sufficient to encircle the head at the hairline (i.e., a length equal to at least about the hairline circumference) and a longitudinal width of at least a few inches. This band region 101 includes the slip-resistant material 215 and serves the function of securing the wrap about the head in a generally slip-resistant position and conformation. The primary fastener pair 201 and 301 will be positioned within the band region, because it participates in this securing function. The wrap may have one or more extension 103 portions which extend beyond the band region 101. By way of example, the wrap illustrated in FIG. 1 has three extensions 103, all of different sizes and shapes and each much smaller than the band region. Further by way of example, the wrap illustrated in FIG. 3 has a single large extension 103 that is much larger than the band region, while the wrap illustrated in FIG. 2 does not include an extension at all.

The wrap can, and preferably does include at least a second fastener pair, herein designated a "secondary" fastener pair 205 and 305. As with the primary fastener pair, one half of the secondary fastener pair 205 borne by the proximal face 200 of the sheet 400 and the other half 305 by the distal face 300 of the sheet, so that the two halves of the secondary fastener pair 205 and 305 can be connected to one another when the wrap is wrapped around a head. The two halves of the secondary fastener pair are thus laterally spaced apart from one another by a distance that is at least sufficient to permit the pair to be fastened together when the wrap is worn. Also as with the primary fastener pair, the secondary fastener pair may include multiple copies of one half, or optionally of both halves, to facilitate attachment about heads and hairstyles of varying sizes. The secondary fastener pair 205 and 305 need not be as closely adjacent the inferior edge 110 as the first fastener pair, and preferably is spaced significantly farther (i.e., by at least an inch or two) from the inferior edge than is the primary fastener pair. For example, the lateral distance between the two halves of the secondary fastener pair can be from 75% to 125% the lateral distance between the two halves of the primary fastener pair.

In a particularly useful embodiment, the wrap bears both a primary fastener pair 201 and 301 and a second fastener pair 205 and 305 arranged in the following configuration. When the wrap is wrapped about a head and the halves of both fastener pairs are fastened to one another (i.e., the two halves of the primary pair 201 and 301 are attached to each other and the two halves of the secondary pair 205 and 305 are attached to each other), the configuration of the wrap defines two annuli. The first annulus is positioned closely adjacent (and may include) the inferior edge, extends completely around the head at about the position of the hairline (with allowance for the ears as described herein), includes at least some of the slip-resistant material 215, and includes the fastened primary fastener pair 201 and 301. The first annulus is positioned near the top of the forehead, below and in front of the "top front corner" of the skull. The second annulus is positioned superior and dorsal to the "top front corner" of the skull, extends about the head and/or hair, and includes the fastened secondary fastener pair 205 and 305. The diameters of the two annuli are such that neither can easily be slipped over and across the "top front corner" of the skull. The two annuli thus 'anchor' the wrap to the head to a significant degree, inhibiting or preventing its displacement, such as during sleep. This anchoring effect can reduce the amount of slip-resistant material needed to resist displacement, relative to a more loose-fitting wrap not exhibiting these two annuli. This embodiment is not, however, the only functional one A secondary fastener pair provides a number of benefits. One such benefit is simply resilience: if the primary fastener pair fails, the wrap will remain fastened to the head so long as a secondary fastener pair remains fastened. This permits re-fastening of the primary pair without the need to fully re-position and re-wrap the wrap. A secondary fastener pair also provides a "second ring of contact" with the head and hair (as described in the preceding paragraph) that can stabilize the wrap against displacement. Such a stabilizing effect can be enhanced if a slip-resistant material is positioned laterally between the halves of the secondary fastener pair on the proximal face 200 of the wrap.

Yet another benefit is that a secondary fastener pair 205 and 305 can provide a defined shape to the portions of the wrap superior to the inferior edge 110. By way of example, if the wrap 100 has the shape of a large rectangle (e.g., like the band-shaped wrap depicted in FIG. 2, but having an extension 103 region having a longitudinal width equal to that shown in FIG. 3), the primary fastener pair 201 and 301 will be laterally spaced at about the length of the wearer's hairline circumference. If one or more secondary fastener pairs having the same lateral spacing are included in the extension, then when those secondary pairs are fastened, the wrap will take on an approximately cylindrical shape. If, however the lateral spacing of secondary fastener pairs increases as longitudinal distance from the inferior edge increase, then the resulting wrap will exhibit a greater diameter in the superior direction (i.e., it will have a "funnel shaped" appearance on the head, accommodating hairstyles bulkier than the head). Similarly, if the lateral spacing of secondary fastener pairs decreases as longitudinal distance from the inferior edge increase, then the resulting wrap will exhibit a lesser diameter in the superior direction (i.e., it will have a "cone" or "dunce-cap shaped" appearance on the head, accommodating hairstyles narrower, but taller, than the head).

The Wrap 100

Figure 1B:
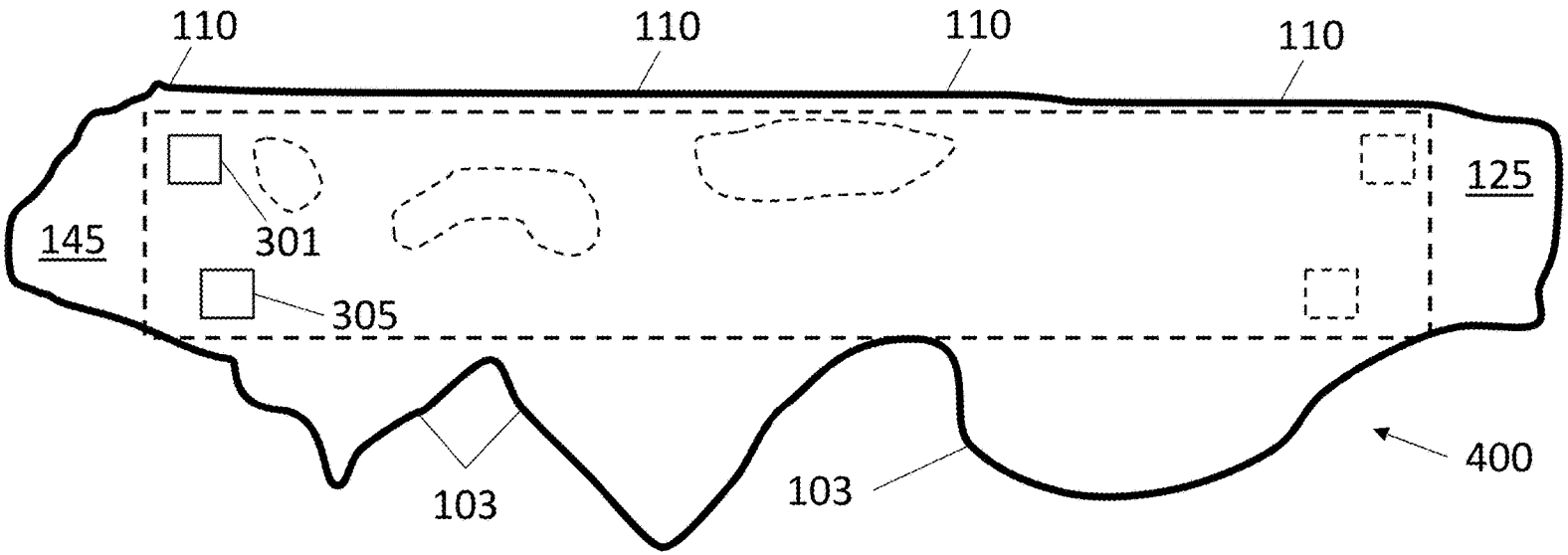

FIG. 1 illustrates the wrap 100 described herein. FIG. 1A depicts the proximal face 200 of the wrap, and FIG. 1B depicts its distal face 300. It can be seen from both FIG. 1A and FIG. 1B that the wrap is, in this embodiment, made from a unitary sheet 400 of material. The sheet includes a band-shaped area 101 having first and second lateral ends 120 and 140 and, in this embodiment, one or more extensions 103. The sheet also includes a first lateral flap 125 at the first lateral end 120 and a second lateral flap 145 at the second lateral end 140. Attached to the proximal face 200, closely adjacent the inferior edge 110 and at or near the first lateral end 120, is a first half of a primary fastener pair 201. The second half of the primary fastener pair 301 is attached to the distal face, about equally closely adjacent the inferior edge 110 and at or near the second lateral end 140. A slip-resistant material 215 is attached to the proximal face, between and laterally in line with the attachment sites of the first and second halves of the primary fastener pair 201 and 301. The wrap also bears a secondary fastener pair, its first half 205 attached to the proximal face and its second half 305 attached to the distal face. In this embodiment, the lateral spacing (horizontal in FIG. 1) between the first and second halves of the primary fastener pair 201 and 301 is greater than the lateral spacing between the first and second halves of the secondary fastener pair 205 and 305.

The wrap 100 includes a band-shaped portion 101 that bears at least the primary fastener pair 201 and 301 and the slip-resistant material 215. The purpose of the band portion 101 is to secure the wrap to the head and to position the slip-resistant material 215 opposite the hairline about some, (preferably) most, or all of the circumference of the head. The primary fastener pair 201 and 301 both secures the wrap in a ring-shaped configuration and assists in opposing the slip-resistant material 215 against the head. The band portion 101 preferably also includes a secondary fastener pair 205 and 305 longitudinally spaced farther from the inferior edge 110 than the primary fastener pair 201 and 301. The secondary fastener pair helps to secure the wrap to the head, both by providing a second 'gripping' circle or ellipse (i.e., in addition to that provided by the first fastener pair) and by positioning those 'gripping' circles or ellipses on opposite sides of the 'top front corner' of the head.

The wrap 100 can optionally include an extension 103 which extends longitudinally between the band-shaped portion 101 and the superior edge 130. When present, the extension 103 can cover or wrap hair that is present within, or extends beyond, the band portion 101 when the wrap is worn. The shape and size of the extension 103 are not critical, and can be selected based on the desired function (e.g., covering versus wrapping or even tying) and the length of the hair. The maximum superior longitudinal extent of the extension 103 can, for example, be 6, 12, 24, or 36 inches beyond the band region 101.

The wrap 100 of claim 1 can further include a tail 105 for facilitating folding or knotting of the wrap about hair contained therein. The tail 105 can be a portion of the sheet 400 extending from the wrap in substantially any direction from substantially any portion of its perimeter. Alternatively, the tail 105 can be a separate piece of material (e.g., one or more ribbons, ties, or flaps) attached to the wrap.

Further details of various parts of the wrap are describe in the following sections.

The Sheet 400

The identity and nature of the sheet 400 from which the wrap is made are not critical, other than that the sheet should be compatible with attachment of at least the slip-resistant material and the primary fastener pair thereto. Suitable sheets include a unitary piece of fabric and laminated or stitched-together fabric pieces. A laminated sheet may include, for example, a proximal sheet having characteristics selected for compatibility with hair contact (e.g., absorbent sheets or water-repelling sheets), a distal sheet having desirable visual characteristics (a visually attractive fabric such as a satin or printed fabric), and one or more medial sheets interposed between the proximal and distal sheets. Medial sheets may, for example, provide padding or sound-proofing (e.g., cotton batting or non-woven polyester fibers), shape-defining (e.g., aluminum foil), or gas- or liquid-barrier (e.g., various plastics such as polyvinyl chloride or polyester) properties. Where multi-layer sheets are used, the layers are preferably attached to one another, such as by stitching or interposed adhesive. Furthermore, where the sheet includes a material that is frayable at its edges, it can be desirable to hem, fuse, or adhere the edges to prevent fraying.

The sheet used to make the wrap should be sufficiently flexible to wrap about the head. It should also exhibit sufficient integrity and tensile strength to withstand the forces associated with wrapping and/or stretching the wrap and with fastening the fastener pairs.

A desirable feature of the sheet used to make the wrap is quietness upon folding. An intended use of the wrap is as headgear for use while sleeping. The wrap will normally be worn near or over the ears, and people commonly roll and turn while sleeping. Accordingly, sheets which make significant noise when deflected (e.g., "crinkly" plastic sheets) are disfavored for use with sleep headgear. By contrast, however, when the wrap is used to contain hair during chemical treatment of hair, inclusion of a fabric which generates noise when deflected can be desirable, as it will dissuade the wearer from disturbing hair during treatment.

Another desirable property of the fabric used to make the wrap pertains to comfort. Especially for wraps intended to be worn during sleep, it can be important that the portions of the wrap which are likely to contact the wearer's skin be pleasing to the touch. Soft, smooth fabrics are widely regarded as comfortable, and any such fabric can be used for such portions. Similarly, portions of the wrap that are exposed on the exterior of the head while the wrap is worn are accessible to be touched, by the wearer or by others, when the wrap is worn. It can be desirable to make these portions from fabrics that are comfortable to the touch.

In some embodiments, the optical transmission properties of the sheet used to make the wrap can be important, such as when it is important that the hair be seen or not-be-seen while wearing the wrap. When the sheet is substantially or fully opaque, hair contained within the wrap will generally not be visible (except for hair portions not covered by the extension). If it is desirable to be able to view the hair while wrapped, a sheer or translucent sheet (e.g., a thin nylon fabric, an open-weave fabric or net, or a transparent plastic sheet) should be used.

Woven textile fabrics, such as are commonly used to make articles of clothing, are suitable sheets from which the wrap can be made. Substantially any such fabric can be used, with light-weight satins being an example of a suitable fabric. Multiple fabrics may be used, such as a sturdy cotton canvas to provide strength to the band region, while a light-weight satin is used for the extension and to line the exterior of the band region. Large open-weave fabrics, such as are commonly used for hair nets and leg stockings, can also be used.

Exterior surfaces of the wrap can be made from fabrics that are printed, woven, or finished in ways which are considered visually pleasing. When the wrap is intended for wear while sleeping, inclusion of exterior features liable to interfere with sleep (e.g., buttons, studs, sequins, rhinestones, or reflective fabrics) should be avoided; such limitations do not apply to wraps intended for waking wear.

The Slip Resistant Material

The identity, nature, and amount the slip-resistant material 215 included in the wrap are not critical. It is desirable to include enough of the slip-resistant material to secure the wrap to the head during ordinary conditions of expected use. Thus, a wrap intended for wear while participating in sessile activities while awake may include less and less-slip-resistant material than a similar wrap intended to be worn while sleeping, and that sleep wrap may include less and less-slip-resistant material than a wrap intended to be worn during exercise or other intense activity.

The slip-resistant material may be a piece of material distinct from, but attached to, the sheet from which the wrap is made or it can be a surface finish to or an integral part such a sheet. The important characteristics of the slip-resistant material is that it deter displacement of the wrap during wear and that it be sufficiently comfortable to wear during anticipated periods of wear (e.g., while sleeping overnight). To that end, it is desirable that the slip-resistant material exhibit a rubbery or 'tacky' surface texture, so that significant friction is manifested when the slip-resistant material is slid tangentially across skin surfaces when the wrap is fastened about the head. The slip-resistant material should not be slick. Tacky textures, such as feel as though the slip-resistant material is releasibly adhered to the skin are acceptable, but the texture should not be so adhesive that hair, lint, fuzz, or other materials which could inhibit slip-resistance adhere thereto.

A wide variety of slip-resistant materials are known, and substantially any of these can be used. A rubberized finish (e.g., a polyethylene-vinyl acetate such as is applied to the soles of slip-resistant socks) applied to the sheet is one preferred version. Other known materials include discrete pieces of natural and silicone rubbers.

The slip-resistant material should be applied at or near the inferior edge 110 of the wrap, preferably laterally in line with the primary fastener pair 201 and 301. This alignment promotes opposition of the slip-resistant material against the head when the halves of the fastener pair are fastened together. The slip-resistant material can line the entire inferior edge of the wrap (see, e.g., the wraps depicted in FIGS. 2 and 3), or one or more lesser portions thereof. FIGS. 5-8 illustrate the approximate position at which the inferior edge of the wrap will normally be worn, and the slip-resistant material can be present at substantially any of these locations, on one or both sides of the head. (Note that in FIGS. 5-8, the inferior edge is positioned behind the wearer's ears; it can also be positioned in front, as in FIG. 11.)

Figure 9A:
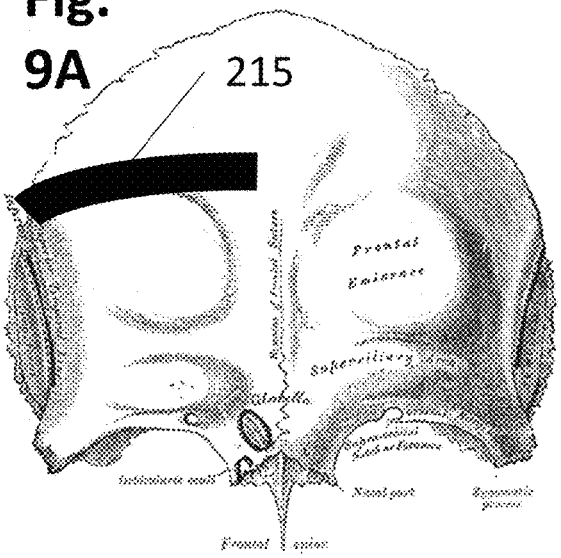
FIG. 9 consists of FIGS. 9A-9D, each of which is a public domain image of a human frontal bone, indicating appropriate approximate sites for placement of one or more portions of the slip-resistant material 215.
Figure 9B:
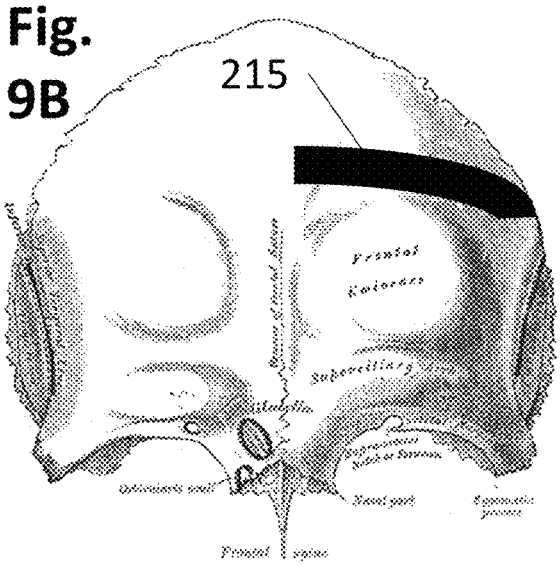
Figure 9C:
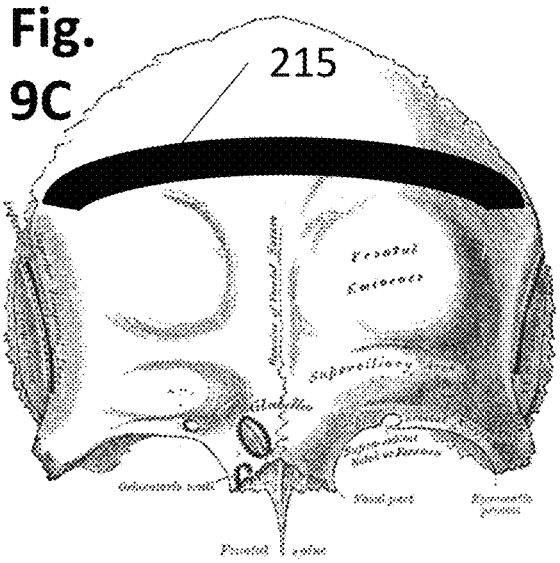
Figure 9D:
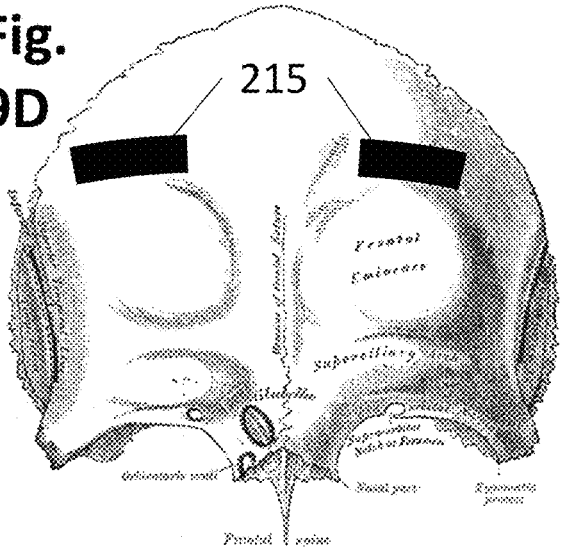

The wrap will normally be worn with the inferior edge at the hairline above the forehead, in part because it is simple to apply the inferior edge accurately to the hairline in this area and in part because this avoids discomfort stemming from occlusion of facial features. The portion of the wrap which will be positioned against the forehead hairline is therefore a particularly useful place to include the slip-resistant material on the wrap. Although it is understood that the cranial topography of human individuals varies significantly, FIG. 9 illustrates that the shape of the skull further makes this portion of the wrap particularly amenable to placement of the slip-resistant material. The human skull tends to form a "top front corner" and has various raised sections ("eminences"). FIGS. 9C and 9D illustrate placement of a strip of slip resistant material above (superior to) both frontal eminences and below (inferior to) the top front corner of the skull; this is the approximate position of the hairline on many humans, as well. FIGS. 9A and 9B illustrate that the slip-resistant material slip-resistant material 215 can be placed over one eminence or the other. A single strip or multiple strips of slip-resistant material can be situated on the inferior edge 110. Preferably, at least about four inches of the inferior edge bear the slip-resistant material (whether as a single strip or multiple portions), and better slip-resistance can be expected the greater the proportion of the inferior edge that bears the slip-resistant material. Even more preferably, the slip-resistant material extends about most or all of the proximal face of the wrap at its inferior edge (or, at least, the non-overlapping portions which will contact the wearer's skin).

Anatomically speaking, it can be expected that the inferior edge of the wrap will normally be worn about the head of a person positioned at an ellipse defined approximately by the portions of the frontal bone immediately superior to the frontal eminences, the right and left external acoustic meatuses (the wrap enclosing the external ears or not), and portions of the inferior surface of the occipital bone ventral the external occipital protuberance and along the dorsal surface of the neck. The slip-resistant material is preferably situated closely adjacent the inferior edge so that it contacts the head at one or more of these positions.

The slip-resistant material is preferably positioned on the wrap so that little or none of the slip-resistant material touches the hair of the wearer while the wrap is worn. The anti-slip texture of the slip-resistant material would otherwise tend to shift hair position when the wrap is applied, removed, or impacted during wearing. Thus, although the entire proximal face of the wrap could be coated with a slip-resistant material, this is disfavored because it would tend to muss the hair contacted by the wrap. The slip-resistant material is preferably applied in a thin band or linear array of dots at or near the inferior edge of the wrap, on its proximal face.

Definitions

As used herein, each of the following terms has the meaning associated with it in this section.

The "approximate hairline circumference" of a person is the distance obtained by measuring as follows. Starting at the center of the person's front hairline, place a thin, flexible measuring tape flat against the person's head, extending the tape just above (i.e., on the hairline side of) one ear towards the back of the person's head, wrapping the tape around the head to the nape of the person's neck, continuing around to the opposite side of the person's head, just above the opposite ear and returning to the center of the front hairline. The distance may also be measured by reference to anatomical landmarks as follows. The distance is equal to the circumference of an ellipse positioned against the exterior surface of the frontal bone superior to the left and right frontal eminences, extending laterally and dorsally across the exterior surface of the left and right temporal bones (crossing the temporal ridges at about the ventral limit of their curvature), and further extending dorsally and proximally about the inferior surface of the tabula of the occipital bone, inferior to and medially of the occipital protrusion. This distance is, practically speaking, about the length of the hairline about which the wrap described herein is intended to roughly circumscribe (with possible allowance for enclosing the person's ears within the wrap if desired). The normal range of approximate hairline circumference values is believed to be in the range from about 18 inches to about 28 inches, and that of children and adolescents is expected to be correspondingly smaller (e.g., about 12 to 22 inches).

A "fastener pair" is a pair of structures shaped or adapted to be reversibly attachable to one another. Each of the pair of structures is herein referred to as a "half" of the fastener pair, regardless of the size or mass of each of the pair of structures (for example, each of a button and a button hole adapted to receive the button are each referred to as a "half" of a fastener pair, despite the differences in their size, shape, mass, and composition). Examples of fastener pairs include hook-and-loop fasteners (e.g., VELCRO® brand fasteners, in which one surface bears plastic hooks able to reversibly snag fibrous loops borne by another surface), common fabric "snap" (i.e., press-stud) fasteners, buttons/toggles and corresponding eyelets (button-holes or looped cords for ensnaring a button/toggle), paired grommeted holes and corresponding studs (e.g., analogous to shirt cuff-links) or strings (e.g., analogous to lace holes and laces in shoes), strings or ribbons which can be tied and knotted together (including both discrete ties and opposite ends of a single tie which extends through or along the wrap), halves of a fabric zipper closing, frog closures, clamps and their targets, buckles and straps, paired hooks, hooks paired with holes or rings, and other devices known in the clothing arts.

EXAMPLES

The subject matter of this disclosure is now described with reference to the following Examples. These Examples are provided for the purpose of illustration only, and the subject matter is not limited to these Examples, but rather encompasses all variations which are evident as a result of the teaching provided herein.

Example 1

This example describes a "band-shaped" embodiment of the wrap 100 described herein. This embodiment is illustrated in FIG. 2.

In this embodiment, the wrap is made from a single piece of fabric (either single- or double-ply fabric) and is hemmed about its edges. The wrap 100 has an essentially rectangular outline, with its four corners optionally rounded to prevent fabric fraying.

Figure 2A:
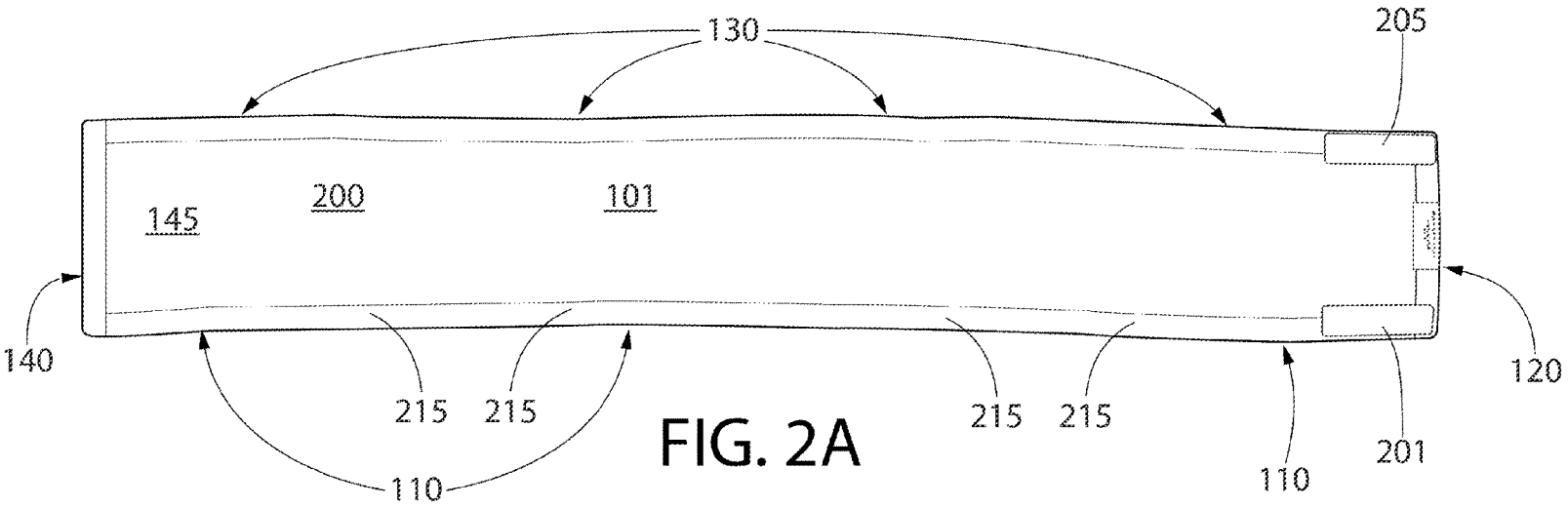
FIG. 2 consists of FIGS. 2A and 2B and is a pair of photographs depicting a first ("band-shaped") embodiment of the wrap 100 described herein.

The photograph in FIG. 2A shows the wrap 100, viewed from above its proximal face 200, with its first lateral end 120 on the right of the figure (bearing a white tag that is immaterial to the subject matter herein, and which can indicate trade names, fabric content, care instructions, or other information) and its second lateral end 140 on the left. Attached at the first lateral end 120 of the wrap, adjacent to and along the inferior edge 110, is a first half of the primary fastener pair 201 which, in this embodiment, is the 'fuzzy' (i.e., loop) face of a two-sheet hook-and-loop type fastener (i.e., a VELCRO® brand fastener in this instance).

Along the bottom of the photograph in FIG. 2A runs the inferior edge 110 of the wrap. This inferior edge 110 is the edge that is drawn about the face and neck when the wrap is applied to a human head, as described below. On the proximal face 200, adjacent the inferior edge 110 is a slip-resistant material 215 which, in this embodiment is a silicone rubber strip that extends along and adjacent to the entire length of the inferior edge 110, except where that edge is covered by the first half of the primary fastener pair 201 at the first lateral end 120 and where the second lateral end 140 forms a hem. In this embodiment, the silicone rubber strip is stitched to the sheet 400, but it could also be glued to it or fused with it. It is this proximal face 200 of the wrap 100 that should be applied against the skin and hair of the person wearing it. Because most of the areas at which the inferior edge will be worn bear little or no hair, the presence of the slip-resistant material 215 at this inferior edge 110 facilitates engagement of the slip-resistant material with the person's skin, which is important for maintaining the wrap in place on the person's head. It is also significant that the first half of the primary fastener pair 201 that is attached to the proximal face 200 is aligned with the slip-resistant material 215 at the inferior edge 110; when the two halves of the primary fastener are engaged with one another, the tension induced in the sheet by such engagement will serve to press and secure the slip-resistant material against the person's skin, contributing to its resistance to displacement.

A first half of a secondary fastener pair 205 is also attached to the proximal face 200. In this embodiment, this first half of the secondary fastener pair 205 is also a rectangular strip of the 'fuzzy' (loop) face of a hook-and-loop type fastener pair. In this embodiment, it is attached at the first lateral edge 120, extending toward the second lateral edge 140 along the superior edge 130 of the wrap. The purpose of the second fastener pair is, like the first fastener pair, to hold the wrap in place once it has been wrapped around the hair of a person.

One feature of this embodiment is that both the first half of the primary fastener pair 201 and the first half of the secondary fastener pair 205 are secured approximately flush against the first lateral edge 120 of the wrap 100 on its proximal face 200. This feature serves to limit the amount of loose fabric that remains unanchored to any portion of the head after the wrap is fastened as described.

Figure 2B:
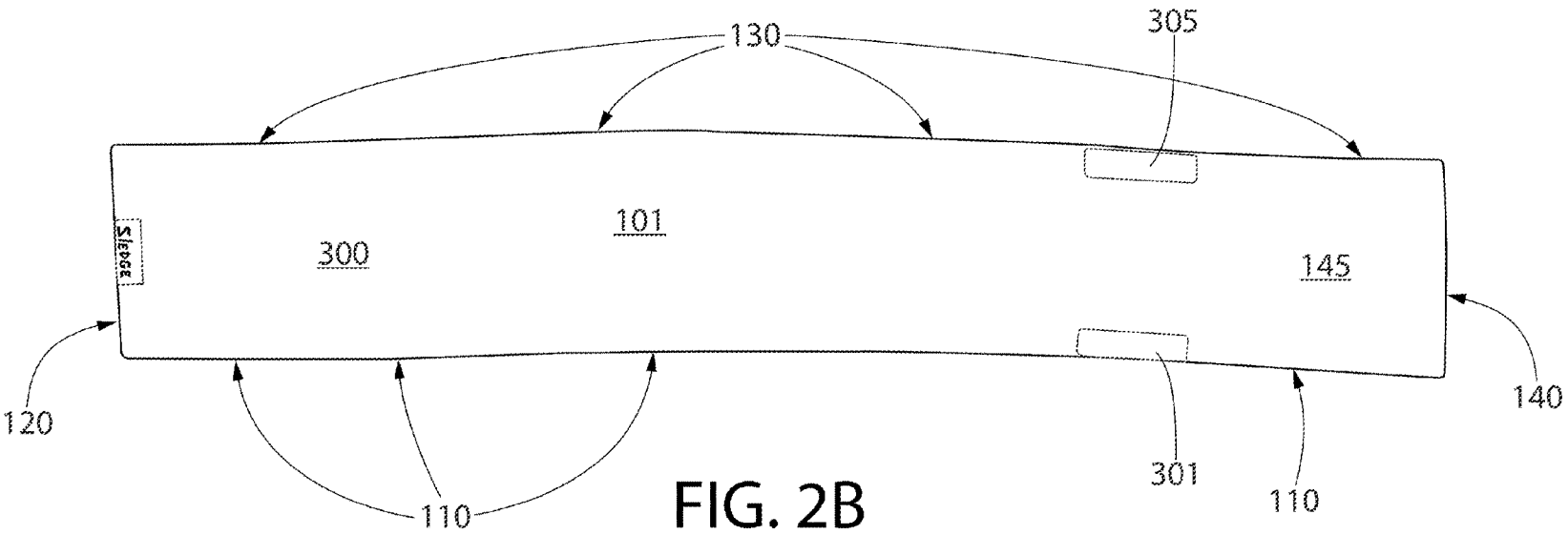

FIG. 2B is a photograph of the distal face 300 (i.e., the face opposite the proximal face 200) of the same wrap shown in FIG. 2A. Effectively, FIG. 2B shows the wrap in FIG. 2A after it has been flipped over laterally; this is evident from the fact that the first lateral end 120 is on the right of FIG. 2A, but on the left in FIG. 2B (note the position of the light-colored label, which wraps around that end of the wrap). In each of FIGS. 2A and 2B, the overall shape of the wrap 100 is essentially "band-shaped;" hence, in each of the two figures the band region 101 encompasses the entirety of each of the proximal and distal faces.

Present on the distal face 300 of the wrap 100 are two halves of fastener pairs. The face bears the second half of the primary fastener pair 301, which in this embodiment is a rectangular strip of the 'hard' (hook) face of the same hook-and-loop type fastener as the first half of the primary fastener pair 201 (i.e., first and second halves 201 and 301 fasten to one another to form the primary fastener pair). The face also bears the second half of the secondary fastener pair 305, which in this embodiment is a rectangular strip of the 'hard' (hook) face of the same hook-and-loop type fastener as the first half of the secondary fastener pair 205 (i.e., first and second halves 205 and 305 fasten to one another to form the secondary fastener pair). Furthermore, the second halves (301 and 305) of the primary and secondary fastener pairs have the same geometric relationship between them as do the first halves (201 and 205) of the same fastener pairs on the proximal face 200. The reason for this identity of geometric relationship is to facilitate simultaneous fastening of the two halves of each of the two fastener pairs once the wrap has been wrapped about the head of a person and the fastener pair-halves are aligned.

Also evident from FIG. 2B is that the second halves (301 and 305) of the primary and secondary fastener pairs are not flush against the second lateral edge 140 of the wrap 100, but are instead spaced laterally away from that edge. The portion of the sheet 400 interposed between the second halves 301 and 305 and the second lateral edge 140 is the second lateral flap 145 (so-named because it is adjacent the second lateral edge, not because there necessarily is another such flap—there is not in this embodiment). Alternatively, the second halves (301 and 305) of the primary and secondary fastener pairs could be attached flush against the second lateral edge 140, in which case the resulting wrap would lack a second lateral flap 145.

The second lateral flap 145 serves at least a few purposes. In this embodiment, in which hook-and-loop fastener pairs are employed, it can be desirable to prevent, or limit the amount of, hair becoming interposed between the halves of fastener pairs (i.e., between halves 201 and 301 and between halves 205 and 305), both to promote fastening of the two halves to one another and to reduce snagging of hair within the fastener. The second lateral flap 145 also provides a convenient surface which can be gripped or held fast against the head while applying the scarf. For example, with reference to FIG. 11A, the fingers of one hand can be used to press the second lateral flap 145 against the head at a desired location while the remainder of the wrap 100 is wrapped about the head, including over top of the fingers pressing against the flap. Prior to fastening the two halves of the fastener pairs together, the fingers can be slipped out (or applied against the exterior of the overlying portion of the wrap), and the wrap can be fastened to the head.

The wrap depicted in FIG. 2 has a lateral width of about 33 inches and a longitudinal width of about 10 inches. Referring to FIG. 2B, the lateral distance between the first lateral end 120 and the left end of the fastener pair halves 301 and 305 is about 21 inches, while the lateral distance between the second lateral end 140 and the right end of the fastener pair halves 301 and 305 is about 9 inches. The fastener pair halves 301 and 305 are each about 3 inches in lateral width, as are those (201 and 205) in FIG. 2A. In FIG. 2A, the slip-resistant material 215 has a lateral width of about 30 inches and a longitudinal width of about 0.75 inch.

The wrap is fastened to a person's head essentially as shown in FIG. 11, for example in order to secure the person's hair while the person sleeps. In FIG. 11, the longitudinal width of the wrap 100 is relatively small (likely about as small as would ever be employed, because so narrow a band will likely secure relatively little hair). Also, the hair of the human head illustrated appears to clings tightly to the human's scalp; the wrap may be of relatively little value to an individual having such a hairstyle. FIG. 11 includes the narrow wrap width and the clinging hairstyle merely for the purpose of simplifying illustration application of the wrap to a human. Furthermore, in FIG. 11 the wrap encloses the human's ears; the wrap can also be applied "over the ears" so as to not-enclose the ears within it, or it can be applied "crossing the ears" (ears partially enclosed), although such application may be uncomfortable.

Figures 11A, 11B, 11C, 11D:
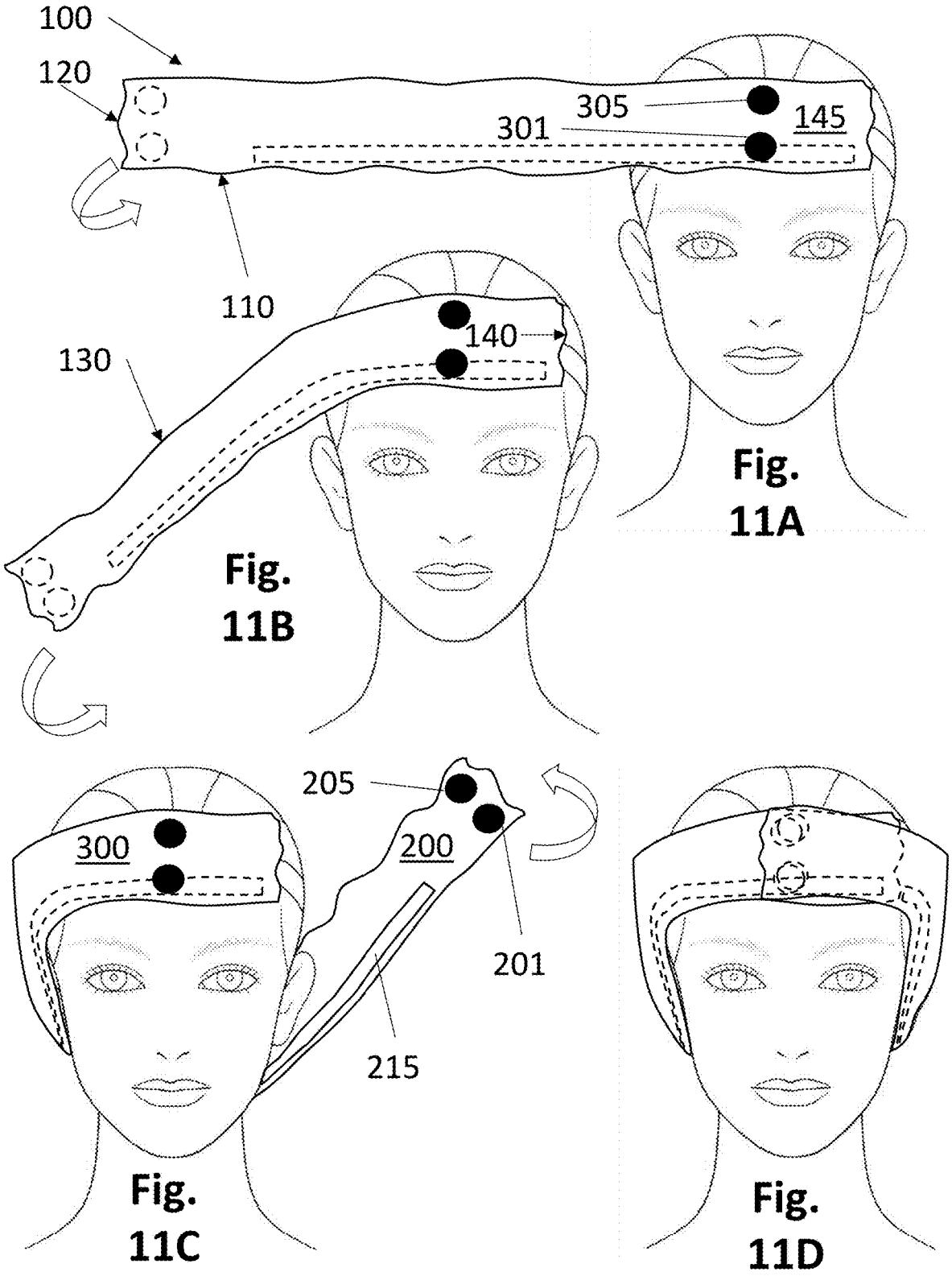
FIGS. 11A-11D illustrate an appropriate way of applying a first ("band-shaped") embodiment of the wrap 100 described herein (i.e., one analogous to that depicted in FIG. 2) to the head of an individual human.

In FIG. 11A, the proximal face 200 of the wrap has been applied against the head of the individual near the second lateral end 140 of the wrap 100. The wrap is applied so that second half of the primary fastener pair 301 is positioned approximately centered between the lateral sides of the forehead, and with the strip of slip-resistant material 215 on the proximal face pressed against the individual's head at about the position of the person's hair line at the vertical center line of the forehead. In this embodiment, the second lateral flap 145 of the wrap extends to the person's left-hand side, and wrap is positioned so that the portion of the slip-resistant material 215 extending between the position of the second half of the primary fastener pair 301 and the second lateral end 140 roughly follows the person's hairline. The remainder of the wrap, including the free first lateral end 120 extend to the person's right-hand side.

While the second lateral flap 145 is held loosely in place, the remainder of the wrap is wrapped about the head of the person in such a path that sequential portions of the slip-resistant material 215 are positioned at about the location of the person's hairline as the remainder of the wrap is sequentially applied against the person's head.

Wrapping is effected by sequentially applying the proximal face 200 of the wrap against the person's head, moving the remainder (including the first lateral end 120) dorsally and inferiorly toward and around/across the person's ear, as shown in FIG. 11B. Dorsal and inferior movement of the free portion wrap is continued until the wrap is applied across the back of the neck, at which point dorsal displacement of the first lateral end halts and is replaced by lateral right-side-to-left-side movement of that end as the wrap is applied across vertical center-line of the nape of the neck and across to the left extent of the back of the neck. Upon (or shortly before) crossing the vertical center-line of the neck, inferior movement of the wrap ceases and movement of the wrap in a superior direction (still causing the line of the slip-resistant material 215 to approximately follow the hairline) commences. As wrapping concludes around the back of the neck, ventral movement of the wrap commences, still following the hairline, the superior and ventral movement continuing as the wrap crosses the left ear and up the left temple, as shown in FIG. 11C.

As the portion of the wrap 100 including the first lateral end 120 is wrapped around the second lateral end 140 (trapping the second lateral flap 145 between the head and the proximal face 200 at the first lateral end 120), the first and second halves (201 and 301) of the primary fastener pair are aligned and can be secured to one another; the first and second halves (205 and 305) of the secondary fastener pair are also aligned and can also be secured to one another, as shown in FIG. 11D. Because the halves of the primary and secondary fastener pairs (201 and 205) on the proximal face 200 are attached nearly flush with the first lateral end 120 of the wrap, little fabric is left loose on the exterior of the head after halves of the primary and secondary fastener pairs are fastened to one another.

In this embodiment, both of the fastener pairs are hook-and-loop type fastener pairs, and the hook-bearing circular strips and the loop-bearing circular strips of each fastener pair extend laterally, permitting "fine tuning" of the tightness of the fit (i.e., the lateral tensional force sustained by the wrap in its fastened position). At this point, the wrap has been fastened to the head and can be left in place for a desired period of time, such as during sleep, while experiencing windy conditions, while bathing, or during application of chemicals to the portions of the hair not covered by the wrap. The ability to customize the fit is enhanced if the fastener pairs are strip-shaped hook-and-loop type fasteners (e.g., as illustrated in FIG. 2) or if multiple halves of one or both fastener pairs are positioned laterally (i.e., as alternative points of attachment).

Figure 10:
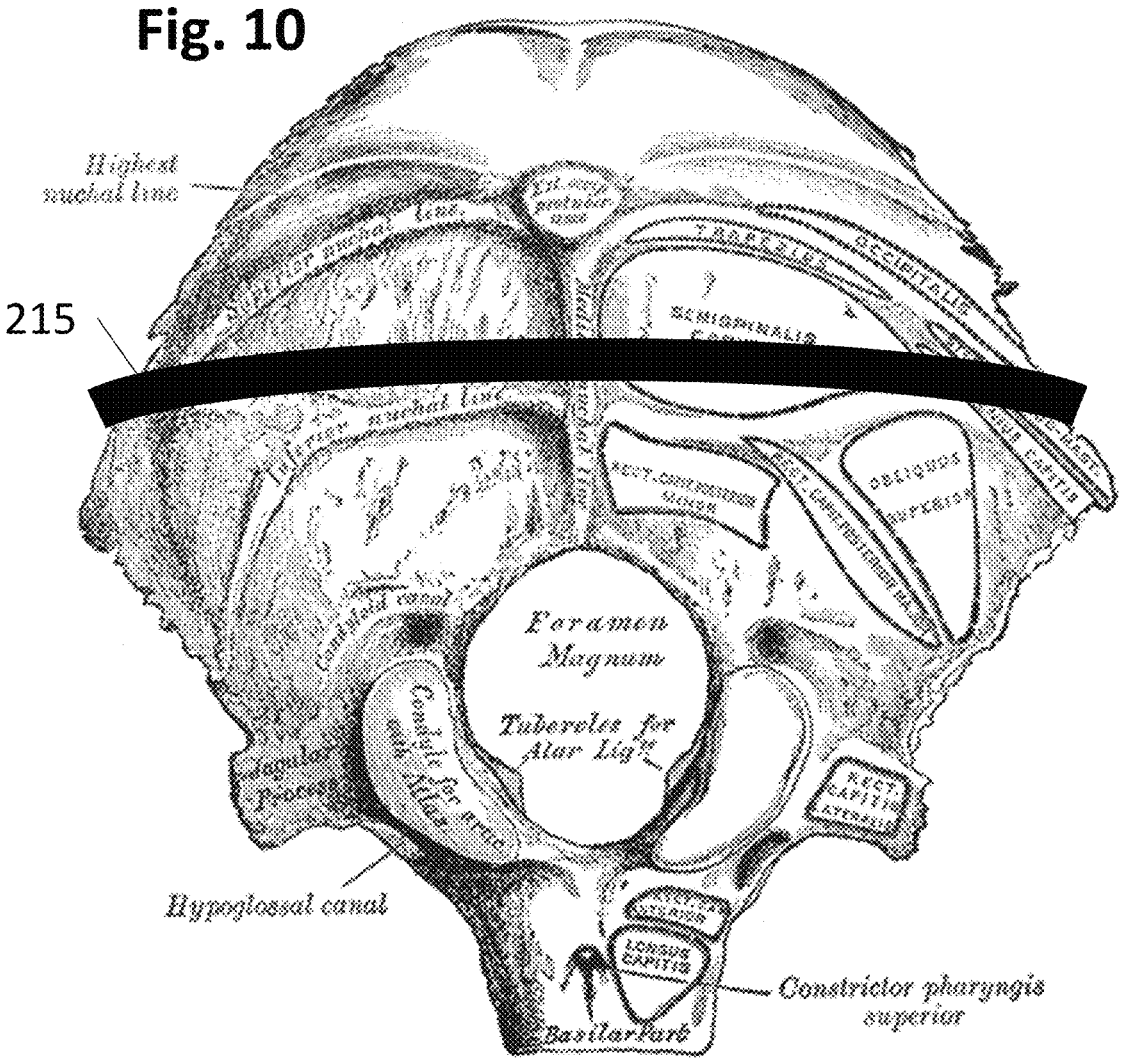
FIG. 10 is a public domain image of a human occipital bone indicating appropriate approximate site for placement of the slip-resistant material 215.

As the wrap is applied around the back of the head and against the nape of the neck, the slip-resistant material 215 should be applied against skin surfaces inferior to and forward of the external occipital protuberance (i.e., "beneath the bump on the back of the head"), both to secure the wrap and to contain the hair (the presence and density of which are highly variable among individual humans in the nuchal area). Still, the slip-resistant material 215 should approximately follow the hairline. FIG. 10 illustrates an approximate position at which the slip-resistant material 215 should be applied in this area, such as during the wrapping shown in FIG. 11C.

The wrap shown in FIG. 11 differs from that shown in FIG. 2 in the quantity and position of the slip-resistant material 215, especially at and near the first lateral end 120 of the wrap 100. In the wrap shown in FIG. 11, there is a substantial gap between the portion of the slip-resistant material 215 nearest the first lateral end 120 and that end. As shown in FIG. 11D, this gap prevents the slip-resistant material 215 from overlapping the second lateral end 140 and the portion of the slip-resistant material 215 nearest the second lateral end 140, which can reduce the bulk of the wrap. Alternatively, the slip-resistant material 215 can extend all the way to the first lateral end 120, as shown in FIG. 2, in which case it will overlap the second lateral end 140 and the portion of the slip-resistant material 215 nearest the second lateral end 140 when the wrap is applied.

When the portion of the wrap corresponding to the position of each ear is applied, following the hair line would entail applying the wrap "over" and "behind" the external ear. Both because this may be uncomfortable or undesirable for some individuals and because enclosing the ears within the slip-resistant material 215 can sometimes better secure the wrap to the head and prevent slippage or displacement of the wrap when worn, the ears may be enclosed within the wrap (as illustrated in FIG. 11D), rather than strictly following the hairline.

The primary fastener pair 201 and 301 in this example is positioned at, or slightly inferior to, the hairline at about the center of the forehead, while the secondary fastener pair 205 and 305 is positioned superior to and slightly dorsal of the hairline at about the center of the forehead. When the wrap is secured firmly to the head, this positioning of the fastener pairs has the effect of fastening the wrap on the "top front corner" of the head and serves to inhibit slippage of the secured portion of the wrap in the superior/dorsal and inferior/ventral directions. Securing the wrap while it is engaged inferior to the "bottom back corner" of the head serves to inhibit slippage of the back portion of the secured wrap in the superior/dorsal direction, while the presence of the neck limits movement in the inferior/ventral direction. The engagement of the slip-resistant material against the skin, hairline, and/or hair tend to decrease both rotational movement of the secured wrap about the axis of the head and slippage in the inferior/superior directions. Taken together, these features cause the secured wrap to tend to retain its position, even when subjected to minor incident stresses, such as those associated with the wearer sleeping with the head engaged with a pillow or bedding, gusts of wind upon the head, and incidental brushing of the head against seats or headrests.

With the wrap secured against one's head as described in this example, a person may maintain their hairstyle while they sleep, drive in a car with the windows open or the car's canopy down, or experience other forces which would normally disrupt or displace hairstyles. Upon waking or when no longer experiencing hair-disrupting forces, the wrap can be simply removed by disengaging one or (preferably) both fastener pairs and unwrapping the wrap.

Example 2

Triangular Hair Wrap

This example describes a "notched-triangular" embodiment of the wrap 100 described herein. This embodiment is illustrated in FIG. 3.

In this embodiment, the wrap is made from a single piece of fabric (either single- or double-ply fabric) and is hemmed about its edges. The wrap 100 has an essentially triangular outline, with its corners optionally rounded to prevent fabric fraying. As illustrated in FIG. 3, the wrap includes a roughly rectangular band section 101, and extension 103 of the wrap at its superior edge 130 confers the triangular overall shape to the wrap. In the particular example illustrated in FIG. 3, one vertex (corresponding to the first lateral end 120) of the overall triangular shape is truncated. Also, a lateral cutout 500 or "notch" is present at the inferior edge 110, one side of the notch defining the second lateral end 140 (which extends, in this example, about ⅔ the distance between the nearby halves of the first and second faster pairs (301 and 305), and the other parts of the notch delimiting a portion of a tail 105.

Figure 3A:
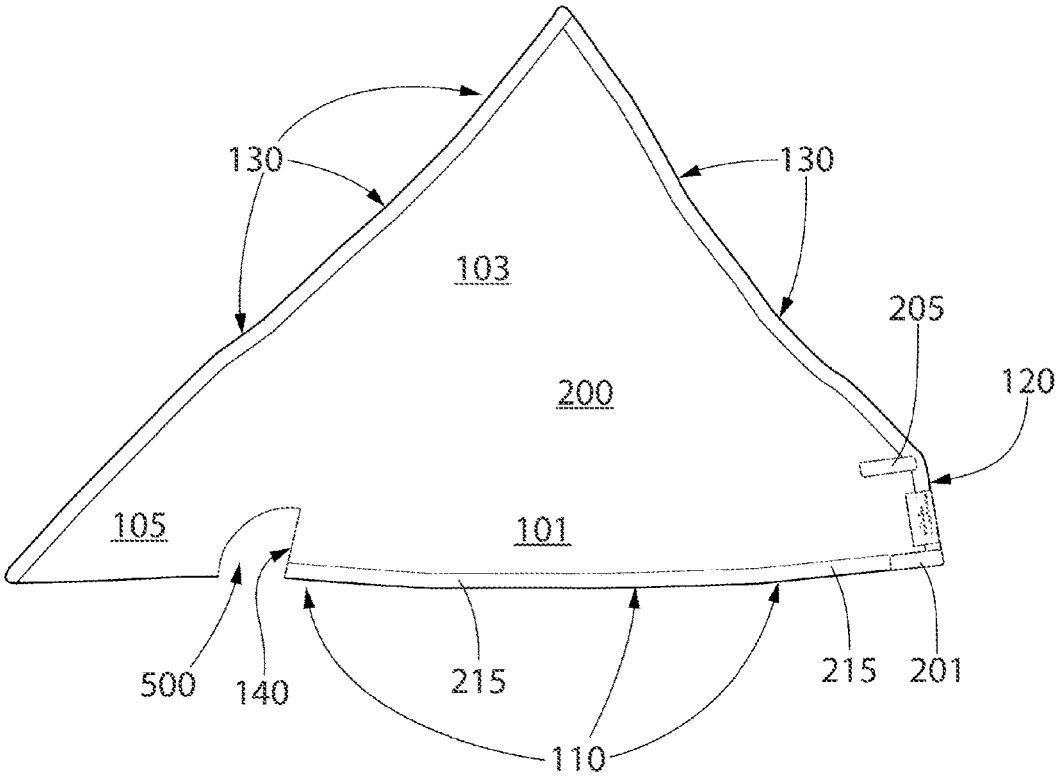
FIG. 3 consists of FIGS. 3A and 3B and is a pair of photographs depicting a second ("notched triangular") embodiment of the wrap 100 described herein.
Figure 3B:
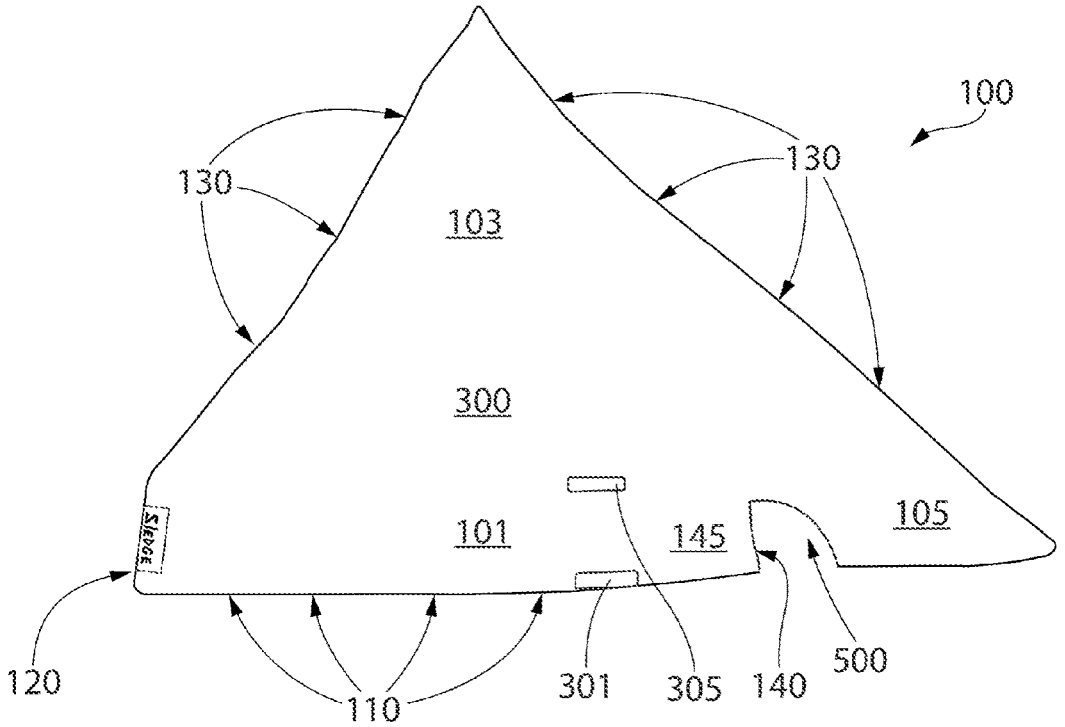
Figure 4:
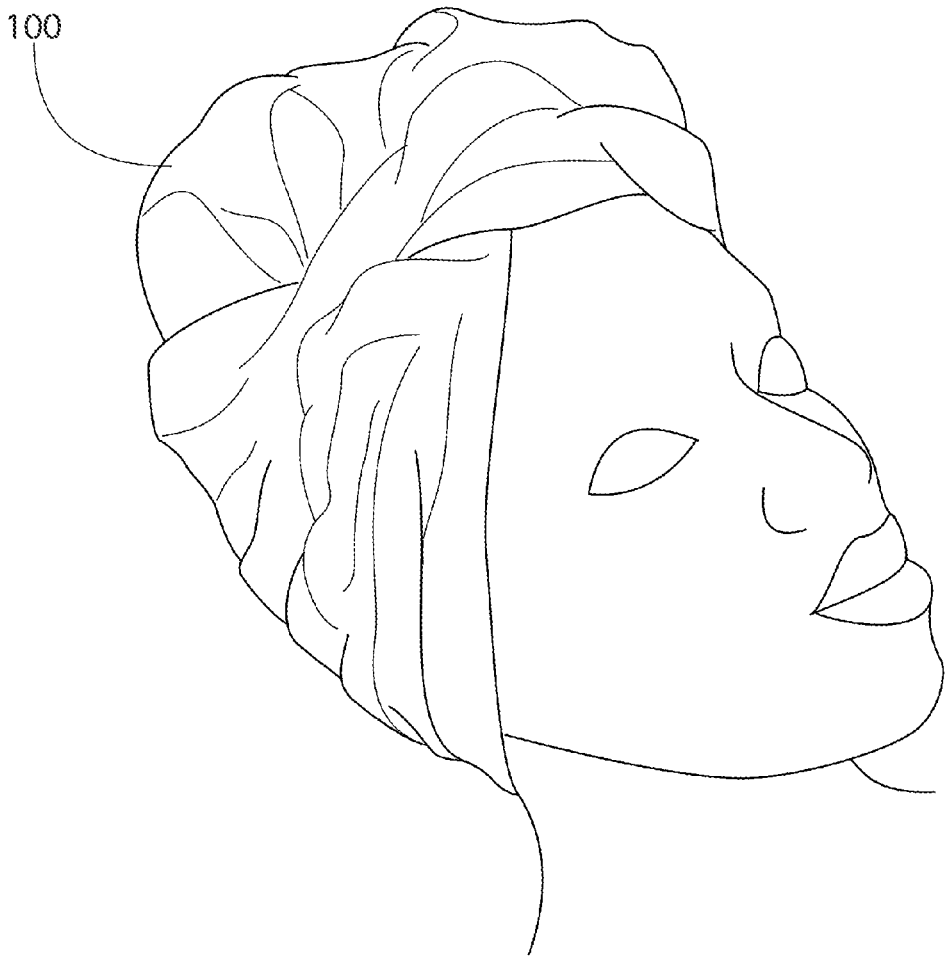
FIG. 4 is a photograph of a notched triangular wrap 100 in use by a reclining person.
Figure 5:
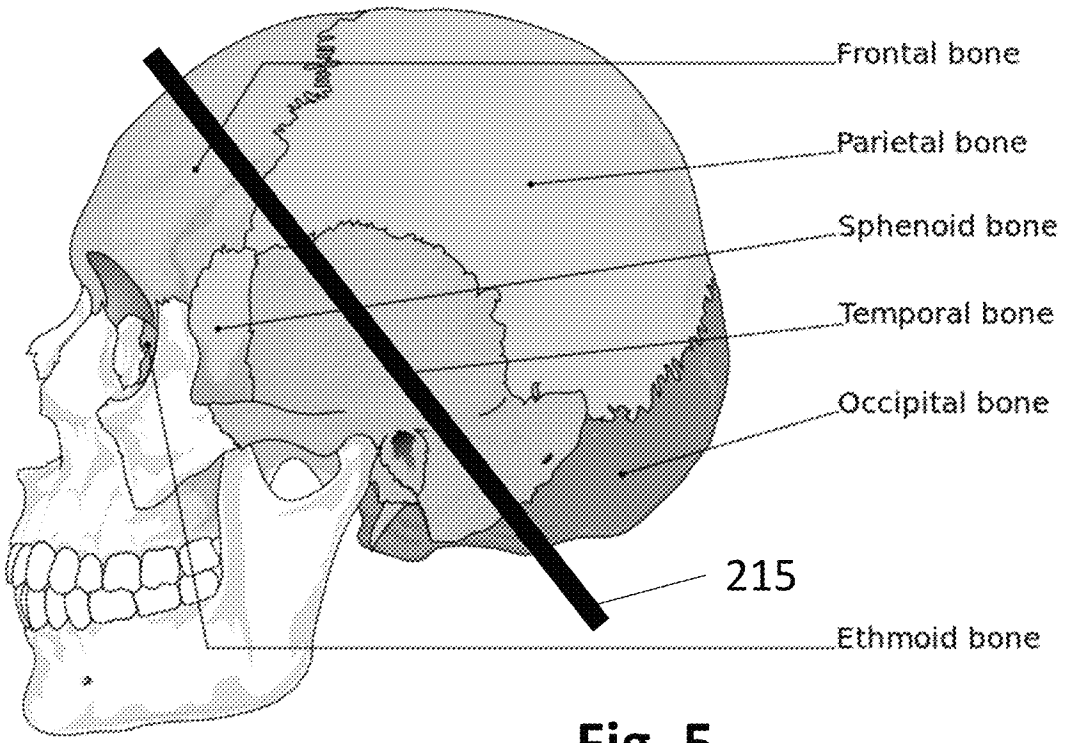
FIG. 5 is a public-domain diagram of the left-side view of a human skull, depicting the approximate placement of a slip-resistant material 215 near the inferior edge 110 of a wrap 100 that completely encircles the head.
Figure 6:
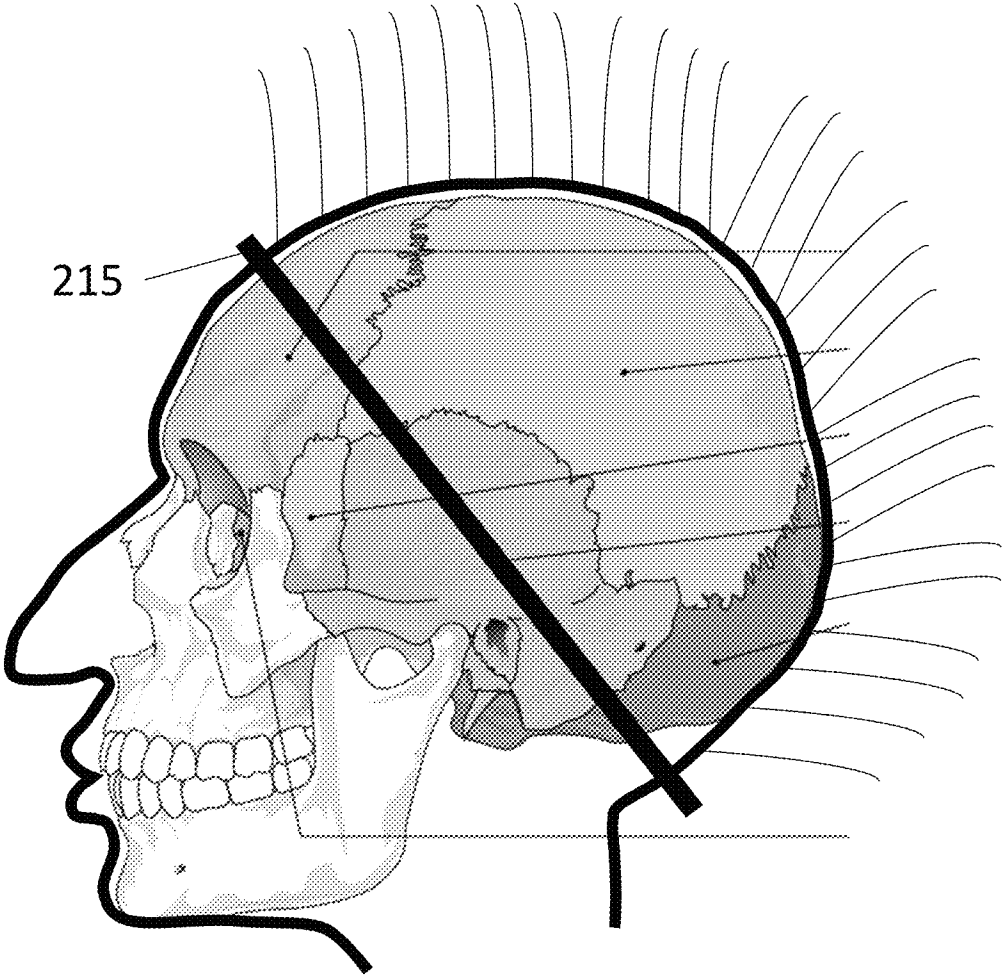
FIG. 6 is analogous to FIG. 5, but has approximate positions of hair and skin added to further explain the approximate position of the slip-resistant material 215.
Figure 7:
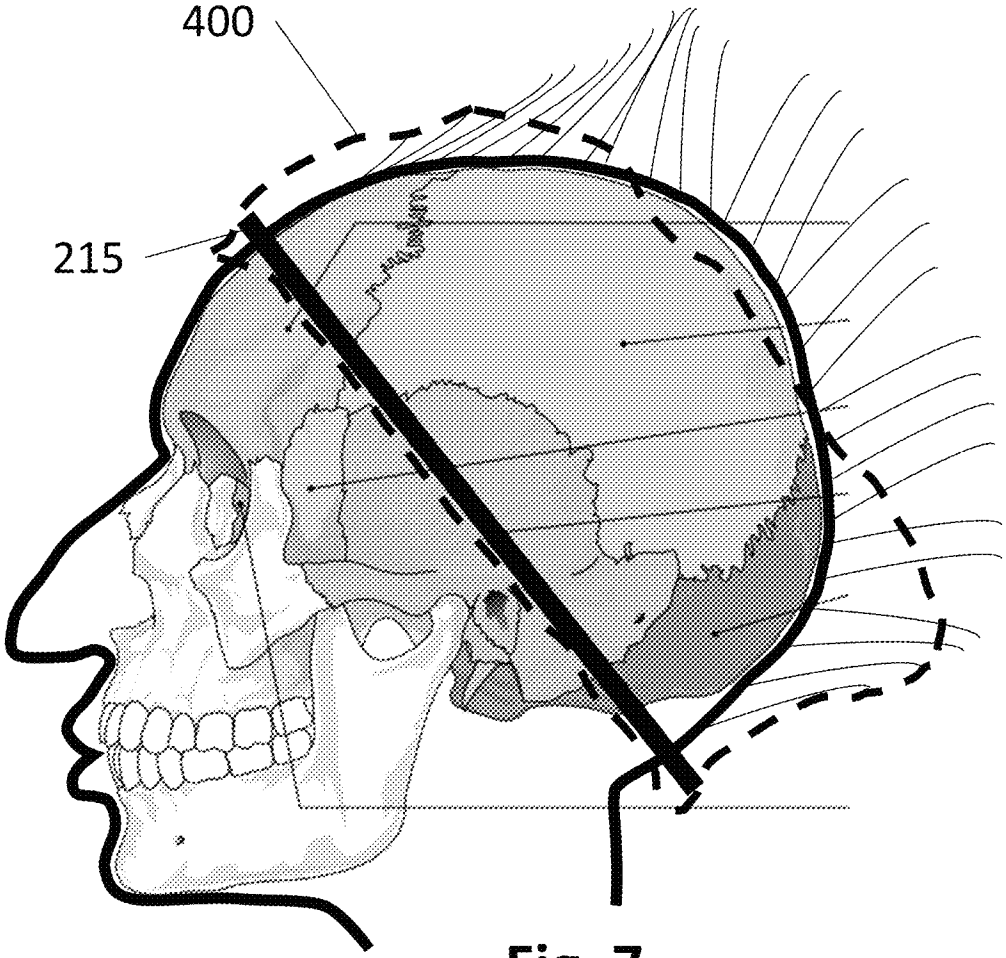
FIG. 7 is a diagram that illustrates how a first ("band-shaped") embodiment of the wrap 100 described herein appears when applied to the head depicted in FIG. 6.
Figure 8:
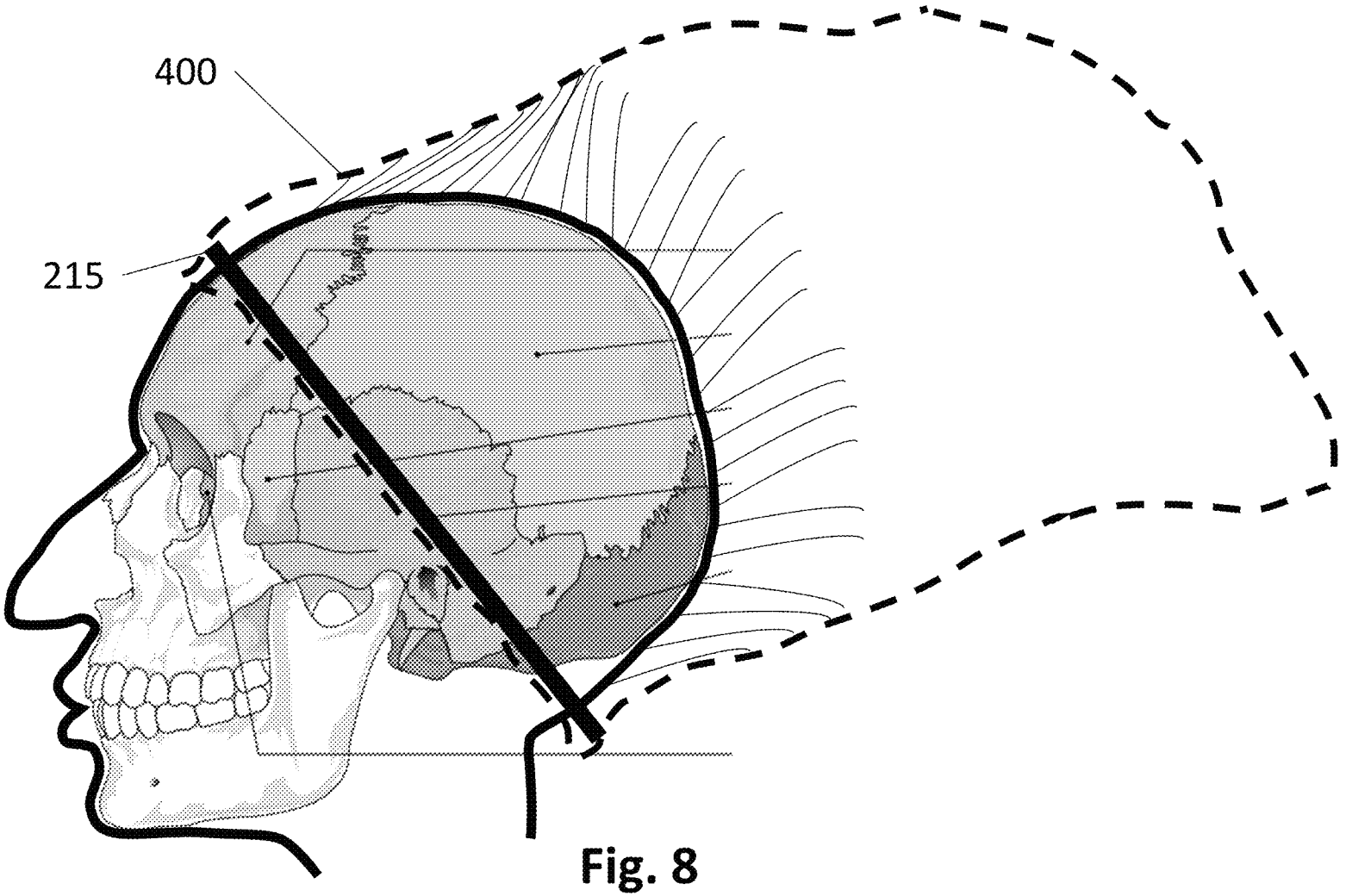
FIG. 8 is a diagram that illustrates how a second ("notched triangular") embodiment of the wrap 100 described herein appears when applied to the head depicted in FIG. 6.

The wrap depicted in FIG. 3 has a lateral width of about 33 inches between the first lateral end 120 and the second lateral end 140. In the longitudinal direction, halves of fastener pairs (201 and 205 in FIG. 3A and 301 and 305 in FIG. 3B) are about 9 inches apart. The blunt first lateral end 120 (on the right in FIG. 3A, on the left in FIG. 3B) has a length in the longitudinal direction of about 10 inches. The length of the superior edge 130 adjacent the first lateral end 120 (again, on the right in FIG. 3A, on the left in FIG. 3B) is about 22 inches.

Application of the wrap shown in FIG. 3 to the head is performed substantially the same way as shown in FIG. 11 and described in Example 1, the difference being that the triangular extension 103 is not shown in FIG. 11. If the wrap shown in FIG. 11 included the triangular extension 103 of the wrap shown in FIG. 3, the extension would extend from the superior edge 130 of the wrap, and would appropriately be 'billowed' about the external surface of the cranial hair as the wrap was applied about the head. Long hair wrapped within the extension could be folded, if desired, or the extension 103 could be wrapped about the hairstyle while disturbing the hairstyle minimally or not at all. Alternatively, long hair (or portions thereof) can be wrapped in the extension 103 and folded or tied, while other portions of the hairstyle are wrapped in the extension without disturbing them.

Figure 11E:
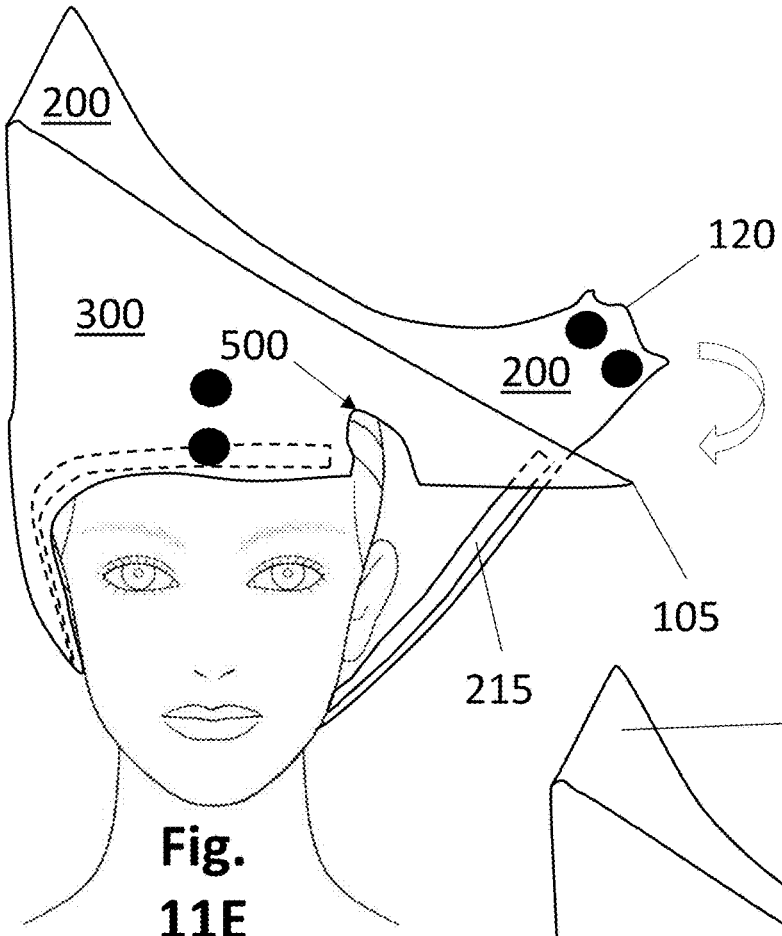
FIGS. 11E and 11F illustrate wrapping a second ("triangular") embodiment of the wrap described herein (i.e., one analogous to that depicted in FIG. 3) to the head of a human.

Similarly, if the wrap shown in FIG. 3 were wrapped around a head as shown in FIG. 11, then the tail 105 visible in FIG. 3 would extend from the second lateral end 140 of the wrap, to the left of the person illustrated. The presence of the tail 105 would not affect the operations shown in FIGS. 11A and 11B. However, as the wrap is brought to the position shown in FIG. 11C, it is apparent that the tail 105 could occlude further wrapping. This situation is illustrated in FIG. 11E, in which the first lateral end 120 extends to the right of left of the person wearing the wrap. To complete wrapping and secure the fastener-halves at the first lateral end to those on the distal face 300, the first lateral end 120 is brought forward, inferior to the inferior edge 110 of the wrap and inserted through the notch 500, leaving the tail 105 free while the fastener halves are fastened to one another. The tail 105 can thereafter be folded or tied with the extension 103 if desired, to further enclose the hair within the wrap.

Figure 11F:
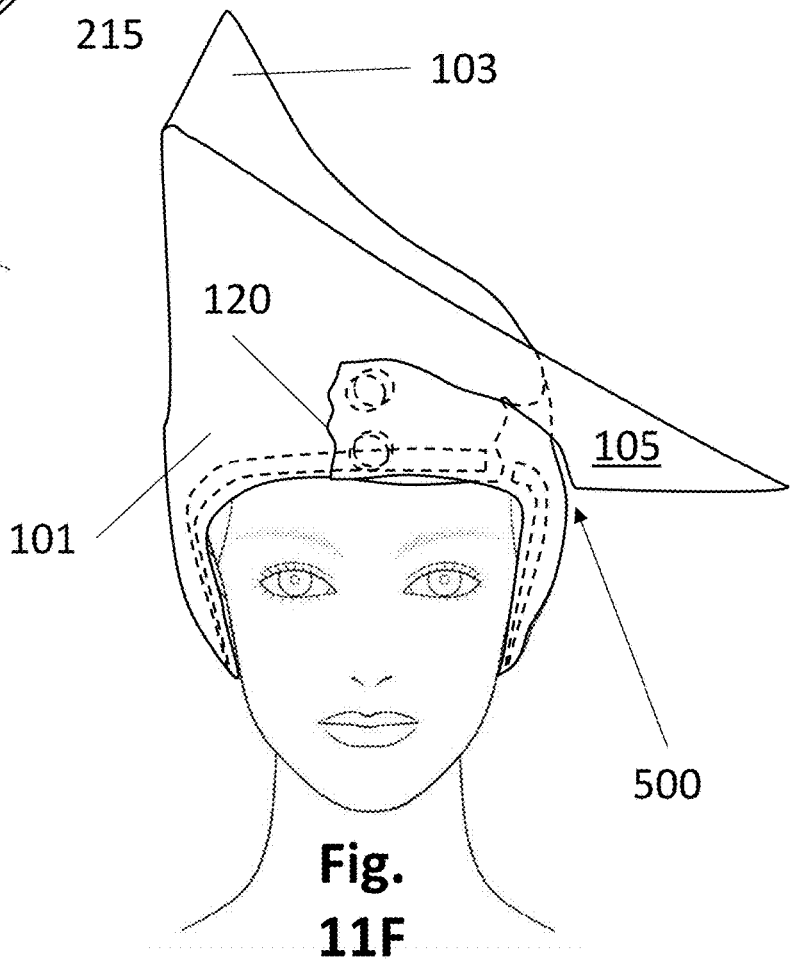

In FIGS. 11E and 11F, the extension 103 is shown as standing erect, which may be possible if the sheet 400 from which the wrap is fabricated exhibits significant rigidity. Because many common fabrics do not exhibit such rigidity, the fabric may fall upon the head if the wrap is applied in an upright, standing position, possibly interfering with wrapping and fastening. For this reason, when the extension 103 possesses significant length or bulk, it can be helpful to apply the wrap while bending—such as bending forward from a standing position or leaning forward, backwards, or to one (or alternating) sides from a seated position. Although not applicable to the human head pictured in FIG. 11 (which has hair which appears to cling tightly to the scalp), delicate, bulky, voluminous, or long curled hairstyles can be enveloped within the extension 103 of the wrap, so as to shield it from rain or wind or to contain it while sleeping.

PARTS LIST

The following list is provided as an aid to describing the indicia intended to be used to refer to the various elements of the subject matter described herein, unless the context of a particular disclosure of an indicium indicates otherwise. In the list, the indicium is followed by its intended meaning.

| | |
|---|---|
| 100 | Wrap |
| 101 | Band Region |
| 103 | Extension |
| 105 | Tail |
| 110 | Inferior Edge |
| 120 | First Lateral End |
| 125 | First Lateral Flap |
| 130 | Superior Edge |
| 140 | Second Lateral End |
| 145 | Second Lateral Flap |
| 200 | Proximal Face |
| 201 | Half of Primary Fastener Pair (on proximal face 200) |
| 205 | Half of Secondary Fastener Pair (on proximal face 200) |
| 215 | Slip-Resistant Material |
| 300 | Distal Face |
| 301 | Half of Primary Fastener Pair (on distal face) |
| 305 | Half of Secondary Fastener Pair (on distal face) |
| 400 | Sheet |
| 500 | Lateral Cutout |

The disclosure of every patent, patent application, and publication cited herein is hereby incorporated herein by reference in its entirety.

While this subject matter has been disclosed with reference to specific embodiments, it is apparent that other embodiments and variations can be devised by others skilled in the art without departing from the true spirit and scope of the subject matter described herein. The appended claims include all such embodiments and equivalent variations.

What is claimed is:

1. A wrap for securing hair on the head of a person, the wrap comprising:

a sheet extending in orthogonal lateral and longitudinal directions, the sheet being of an overall triangular shape having a linear inferior edge extending in the lateral direction, a first linear superior edge extending at an angle to the linear inferior edge, a second linear superior edge extending at an angle to the linear inferior edge, a first lateral end, a second lateral end, a proximal face, and a distal face, the sheet being configured to be wrapped around the head of the person so that the linear inferior edge is extended about the hairline of the person;

a slip-resistant material located on the proximal face adjacent the linear inferior edge and extending along at least a portion of the linear inferior edge;

a primary fastener pair having a first half and a second half configured to be releasably secured together, the first half of the primary fastener pair being located on the proximal face adjacent the first lateral end and adjacent the linear inferior edge, the second half of the primary fastener pair being located on the distal face between the first and second lateral ends, adjacent the linear inferior edge, and further from the first lateral end than the first half of the primary fastener pair is located from the first lateral end, the first and second halves of the primary fastener pair having a lateral distance separating them, with the lateral distance being configured to be equal to the approximate hairline circumference of the person; and a secondary fastener pair having a first half and a second half configured to be releasably secured together, the first half of the secondary fastener pair being located on the proximal face adjacent the first lateral end and spaced from the linear inferior edge, the second half of the secondary fastener pair being located on the distal face between the first and second lateral ends, spaced from the linear inferior edge, and further from the first lateral end than the first half of the secondary fastener pair is located from the first lateral end, the wrap being configured to substantially contain the hair of the person within the sheet when the sheet is wrapped about the head of the person with the linear inferior edge of the sheet extended about the hairline of the person, with the first and second halves of the primary fastener pair releasably secured to one another, and with the first and second halves of the secondary fastener pair releasably secured to one another.

2. The wrap of claim 1, wherein the lateral distance between the first and second halves of the secondary fastener pair are from 75% to 125% the lateral distance between the first and second halves of the primary fastener pair.

3. The wrap of claim 2, wherein the lateral distance between the first and second halves of the secondary fastener pair is approximately equal to the lateral distance between the first and second halves of the primary fastener pair.

4. The wrap of claim 1, wherein the lateral distance between the two halves of the primary fastener pair is from 18 to 28 inches.

5. The wrap of claim 1, wherein the lateral distance between the two halves of the primary fastener pair is from 12 to 22 inches.

6. The wrap of claim 1, wherein the primary fastener pair is a hook-and-loop fastener pair.

7. The wrap of claim 6, wherein the primary fastener pair is a pair of elongated hook-and-loop fastener strips.

8. The wrap of claim 7, wherein at least one of the strips extends at least about four inches along the inferior edge.

9. The wrap of claim 1, wherein the primary fastener pair comprises a single first half of the pair and multiple second halves of the pair.

10. The wrap of claim 9, wherein the primary fastener pair comprises a single hook and multiple loops spaced laterally along and adjacent the linear inferior edge.

11. The wrap of claim 1, wherein the sheet has a band-shaped portion and includes an extension extending longitudinally between the band-shaped portion and one of the linear superior edges.

12. The wrap of claim 11, wherein at least one part of the extension extends longitudinally at least six inches beyond the band-shaped portion.

13. The wrap of claim 1, wherein the sheet consists of a unitary piece of fabric.

14. The wrap of claim 1, wherein the sheet comprises a laminated plurality of fabric pieces.

15. The wrap of claim 1, wherein the sheet comprises multiple laminated sheets including outermost laminated sheets and at least one other laminated sheet, the outermost laminated sheets being fabrics, and at least one other laminated sheet being other than a woven fabric.

16. The wrap of claim 1, wherein the sheet is substantially opaque.

17. The wrap of claim 1, wherein the sheet is a mesh having inter-strand openings with a short dimension of at least 1/16 inch.

18. The wrap of claim 1, wherein the slip-resistant material is a rubberized finish applied to the sheet.

19. The wrap of claim 1, wherein the slip-resistant material is a discrete material attached to the sheet adjacent the linear inferior edge.

20. The wrap of claim 19, wherein the material is selected from the group consisting of natural rubbers, silicone rubbers, and polyethylene-vinyl acetates.

* * * * *